United States Patent [19]

Archambeault

[11] Patent Number: 4,528,680

[45] Date of Patent: Jul. 9, 1985

[54] APPARATUS FOR COUNTING ARTICLES TRAVELING IN A RANDOM PATTERN

[76] Inventor: William J. Archambeault, P.O. Box 508, Goleta, Calif. 93116

[21] Appl. No.: 520,510

[22] Filed: Aug. 4, 1983

[51] Int. Cl.[3] ..... G06M 7/00

[52] U.S. Cl. ..... 377/6; 209/551; 209/587; 377/10

[58] Field of Search ..... 377/6, 10; 209/563, 209/564, 565, 587, 576, 551; 250/221, 222.1, 222.2, 223

[56] References Cited

U.S. PATENT DOCUMENTS

| | | | |
|---|---|---|---|
| 4,139,766 | 2/1979 | Conway | 377/6 |
| 4,147,619 | 4/1979 | Wassmer et al. | 209/587 |
| 4,186,839 | 2/1980 | Wassmer et al. | 209/587 |
| 4,276,983 | 7/1981 | Witmer | 250/223 R |
| 4,281,765 | 8/1981 | Brazell et al. | 377/6 |
| 4,308,959 | 1/1982 | Hoover et al. | 250/223 R |
| 4,356,387 | 10/1982 | Tsubota et al. | 377/6 |
| 4,369,886 | 1/1983 | Lane et al. | 209/587 |

*Primary Examiner*—John S. Heyman
*Attorney, Agent, or Firm*—Daniel J. Meaney, Jr.

[57] ABSTRACT

Apparatus for counting articles traveling in a random pattern along a predetermined path in a selected direction comprising an article counting stage which is positioned along the predetermined path, a source positioned relative to the article counting stage for producing in a scan pattern a plurality of pulsed, spaced parallel beams of radiation such that each article is adapted to independently intercept at least two beams of radiation and to produce therefrom at least two pulses of radiation, each of said beams being directed along a scan path into the article counting stage wherein selected beams of radiation are adapted to be intercepted by a selected portion of the article passing through the article counting stage, a radiation pulse receiver for receiving the at least two pulses of radiation intercepted by and the article and which produces therefrom output signals in a time spatial sequence representing the radiation level of the at least two received pulses of radiation exceeding a threshold level with a time spatial sequence between the pulses commencing with the first received radiation pulse output signal and a logic circuit which is responsive to the output signals and responds to the first received radiation pulse output signal to produce and pass a count signal and to inhibit passing of count signals produced from later received radiation pulse output signal from the same article unless a later received radiation output pulse is of a greater amplitude or duration whereupon the count signal produced therefrom is passed and the count signals from the first received radiation pulse output signal and other count pulses are inhibited as shown. A method for counting articles traveling in a random pattern along a predetermined path in a selected direction is also shown.

21 Claims, 20 Drawing Figures

APPARATUS FOR COUNTING ARTICLES TRAVELING IN A RANDOM PATTERN

BACKGROUND OF THE INVENTION

1. Field of the Invention

This invention relates to an apparatus and method for counting articles traveling in a random pattern along a predetermined path in any selected direction and for producing a total count of such articles and more particularly to an apparatus for counting articles traveling in a random pattern along a predetermined path in a selected direction which is adapted to pass through an article counting stage wherein a plurality of pulsed, parallel radiation beams are intercepted by each article to be counted which is received by a receiving means which produces output signals which are analyzed by a logic circuit to produce count signals which are totaled to produce a total count of articles.

2. Description of the Prior Art

It is known in the art to count articles, such as for citrus fruit, which are passed by a conveyor line through an article counting stage in a random pattern by means of a mechanical, microswitch devices. In the known counting apparatus, the microswitchs are positioned relative to the conveyor such that the surface of passing fruit is urged against a microswitch closure contact causing one or more of the microswitches to close. Closure of the microswitches is converted into a count of the total fruit passed through the counting stage.

It is known in the art to utilize sorting apparatus and method which comprises a viewing area, a removal area and a conveyor for passing a thin bed of indiscriminately mixed items first through the viewing area and then through the removal area. The inspection of the items passing through the viewing area is accomplished by a radiant energy source which produces two bands of mutually different wavelengths, one of which is visible light and the other of which is infrared radiation. A dual diode array, a scanning camera having paired electrodes are focused respectively on a contiguous subareas of the viewing area such that the diodes of each pair will sense the different energy wavelengths, respectively, reflected from the corresponding subarea of the viewing area so that comparison circuitry of the camera will produce resultant data signals for those diode pairs for which the sensor relationship is the predetermined relationship. The resultant data signals are sent to control circuitry arranged to actively corresponding ones with a plurality of devices for removing items from the bed as it passes through the removal area. The apparatus and method of the system are described in detail in U.S. Pat. No. 4,186,836.

It is also known in the art for sorting apparatus to utilize a light radiation source which is directed upon a viewing area and through which articles to be inspected and sorted are passed wherein the detection apparatus comprises electrical circuitry which is responsive to light reflected from the article and to process the signals form the detector to perform a function, such as for example rejecting an article further on down the processing line. Typical of such systems are those disclosed in U.S. Pat. Nos. 3,776,381; 3,867,039; 4,106,628; 4,134,498; 4,147,619; 4,207,985; and 4,276,983.

The apparatus disclosed in U.S. Pat. No. 3,776,381 employs light sensative cells for receiving light reflected from a product passing through a viewing zone to detect products that are too light, too dark or defective. The signal processing circuitry utilizes active filters, a comparator and a peak detector to indicate product flow and to generate control signals which are ultimately used to perform a down-line function such as controlling a product reject mechanism.

U.S. Pat. Nos. 3,867,039; 4,106,628 and 4,132,314 utilize detection apparatus which monitor and control articles by size and/or color. U.S. Pat. No. 4,132,314 utilizes a radiation light source comprising two different color bands, such as for example red and green, and a pair of phototransistors which are responsive to the light reflected from the objects in the two different color bands.

U S. Pat. No. 4,134,498 discloses an apparatus for sorting articles randomly disposed across a wide path by a plurality of side-by-side viewer elements each designed a corresponding side-by-side sector of an illuminated viewed area through which the articles to be sorted pass. Electrical signals indicative of the instantaneous average value of light reflected from articles at two predetermined wavelengths as those articles pass through a sector of the viewed area a multiplex and a classification signal functionally related to the ratio of the two signals is determined. The classification signal is compared to a reference signal indicative of an article having a predetermined physical characteristic and a reject signal is generated if the compared signals differ by a predetermined amount. The reject signal is ultimately stored in the memory location and then utilized to actuate an article ejector further down the processing stream.

U.S. Pat. No. 4,147,619 discloses apparatus for sorting items, such as pealed whole potatoes, which exhibit substantially uniform light reflectivity and wherein the apparatus includes an illumunation chamber through which the items to be sorted are passed successfully as a stream. Light sensors are focused on a cross-sectional slice of the illumination chamber through which the items pass, each of those light sensors being focused only on a small portion of the slice. Electronic circuitry in conjunction with the light sensors counts the number of sensors sensing abnormalities. If the number of sensors sensing abnormalities is greater than a predetermined minimum, a reject signal is produced and utilized to eject such item further down the processing stream.

U.S. Pat. No. 4,207,985 discloses apparatus for sorting articles which is responsive to light reflected from the same portion of an article to be sorted wherein the reflected light is detected as against a first and second background wherein the first background has a reflectivity characteristic greater than the reflectivity characteristic of the second background and an electrical signal is generated which is representative of the portion of the viewing zone occupied by the article. The electrical signal is used to scale both the first and second signals to provide an electrical signal representative of the reflectivity of the article at the first and second color wavelengths. The apparatus is further characterized by an article classifier which classifies the articles on the basis of the intensity of light reflected at the first and second color wavelengths and the signals generated therefrom are stored and ultimately used to operate an ejector mechanism to divert the therefrom.

U.S. Pat. No. 4,276,983 discloses a sorting apparatus for sorting objects which travel, in a spaced aligned relationship, in a predetermined direction or path. The sorting apparatus includes equipment for emitting light within a given frequency range and which is located in such a position so as to illuminate at least a portion of the objects traveling in the predetermined direction. The sorting apparatus further includes equipment for detecting at least a portion of the reflected light resulting from the illumination of at least a portion of each of the objects that are subject to the emitted light. The output of the detection equipment is utilized to provide signals for sorting the objects based upon the detection of the reflected light and includes provisions for varying the capability of receiving various intensities of reflected light in a given frequency range.

U.S Pat. No. 3,768,645 discloses an apparatus and method which utilizes an X-ray source which is orientated relative to a conveyor for transporting articles, particularly citrus fruits, along a predetermined path. The apparatus utilizes the X-rays for evaluating the articles on the basis of uniformity and nonuniformity of their transparency to X-rays and to utilize such differences for selectively separating the same into different grades. The fruit is oriented and carried by a conveyor along a path between an X-ray source and X-ray detector which is positioned to strattle the core of the fruit. Signals from the X-ray detectors are applied to a computer controlled by timing sensors which are responsive to fruit movement through the X-rays wherein the percentage of internal damage is computed for each fruit and the fruits are then separated according to grades downstream from the sensing and detecting stage.

SUMMARY OF THE PRESENT INVENTION

This invention relates to a new, novel and unique apparatus for counting articles traveling in a random pattern along a predetermined path in a selected direction. The apparatus includes means positioned along the predetermined path for defining an article counting stage which is adapted to have passed therethrough articles to be counted which are traveling in a random pattern along the predetermined path in a selected direction. The apparatus further includes means positioned relative to the article counting stage for producing in a scan pattern thereacross a plurality of pulsed, spaced beams of radiation, each of which is directed along a scan path into the article counting stage and each of which is adapted to be intercepted by a selected portion of the articles passing through the article counting stage. In the preferred embodiment, each selected portion of an article reflects therefrom a pulse of radiation which travels along a reflection path. The radiation beam producing means is adapted to produce a plurality of pulsed, spaced beams of radiation in a scan pattern such that each article is adapted to have at least two selected portions thereof independently intercept at least two beams of radiation and to reflect or produce therefrom at least two pulses of radiation which travel along different paths. The apparatus further includes means positioned relative to the article counting stage and positioned relative to the radiation beam producing means for receiving at least two pulses of radiation from at least two separate radiations beams being intercepted by an reflected from different selected portions of the article and for producing therefrom output signals in a time spatial sequence representing that the radiation level of at least two received pulses of radiation exceeded a threshold level and with a time spatial sequence therebetween commencing with the first received radiation pulse output signal. A logic means is operatively coupled to the radiation receiving means for receiving the output signals and for responding to the first received radiation output signal to produce a count signal. In addition, the logic means responds to the later received radiation pulse output signals to produce an inhibit signal which inhibits producing of a subsequent count signal for the same article.

The present invention overcomes certain problems associated with the prior art devices. In the known prior art device which is adapted to count spherical objects in a random pattern depends upon sliding contact between the surface of the fruit and closure of one or more microswitches in order to initiate a count. In such apparatus, the ability of the fruit to close the microswitch closure contact depends upon the firmness of the fruit, the toughness of the outer skin and the fruit's ability to contact and slidably engage the microswitch to close the same without damaging the fruit. The microswitches are interconnected in a logic array to pass a count signal from only one microswitch in the event more than one microswitch is activated.

Certain of the prior art systems utilize differential detecting means which are responsive to light reflected from the surfaces of the articles and for processing the signals to produce a control signal to perform a further function downstream along the predetermined path. The sensing and detecting apparatus requires filters, circuitry which is responsive to differential wavelengths signals produced from radiation devices which are responsive to different wavelengths for producing differential signals. These detecting systems generally utilize radiation sources which are continually flooding a viewing area with radiation which area is continually detected by receiving means which are responsive to reflected light signals from the continuously produced radiation sources. Further, the signals derived from the radiation receiving circuitry are utilized to perform other functions further downstream such as ejecting or sorting articles so sensed.

One advantage of the present invention is that the radiation source utilized in the preferred embodiment is infrared radiation which can be emitted from an infrared light emitting diode.

A further advantage of the present invention is that the radiation beam producing means can be formed from a plurality of aligned infrared light emitting diodes which are capable of being pulsed in a predetermined relationship to produce a plurality of spaced, parallel radiation beams which are directed into an article counting stage and which in one embodiment, are intercepted by articles to be counted thereby which are being passed through the article counting stage.

A further advantage of the present invention is that the radiation beams can be produced in a scan pattern such that the relative movement of the article relative to two spaced radiation beams can be utilized for detecting and counting an article.

A yet further advantage of the present invention is by the use of pulsed, spaced parallel radiation beams, an article can have two different selected portions thereof intercept two separate independent radiation beams and to produce in response thereto two separate radiation pulses having a time spatial relationship therebetween which is a function of the relationship between the source of the pulsed radiation beam relative to the selected portion of the article at the time that the pulsed beam is intercepted by the selected portion of the article.

A still yet further advantage of the present invention is that the radiation receiving means angle of response can be coordinated with the width of the pulsed radiation beam to produce a threshold range which can count articles having varying geometrical dimensions which are passed through the article counting stage.

A still yet further advantage of the present invention is that the radiation beam producing means can produce and direct the pulsed, spaced radiation beams in a scan pattern at a selected angle into the article counting stage so as to intercept and to have an apparent depth penetration into the article being counted. When the article intercepts the pulsed radiation beam, a radiation pulse is reflected therefrom. A portion of the reflected radiation is within the viewing angle of the detecting means. The counting apparatus has a threshold range enabling the apparatus to count articles of varying geometrical dimensions.

A still yet further advantage of the present invention is that the apparatus for counting articles can be utilized for counting articles being transported by a conveyor means past an article counting stage wherein the articles can be randomly positioned on the conveyor means.

A still yet further advantage of the present invention is that the apparatus for counting articles can count articles of different geometrical dimensions such as for example citrus fruit which is transported by a conveyor through an article counting stage.

A still yet further advantage of the present invention is that the articles to be counted can be arranged in a thin web of articles randomly passing through an article counting stage such that the relationship between the radiation source and the receiving means and the distance therebetween can be utilized to count the articles flowing randomly through the article counting stage.

A still yet further advantage of the present invention is that electrical circuitry can be utilized for producing triggering pulses at a predetermined frequency which can, in turn, be utilized to trigger a firing means for firing the infrared light emitting diodes in a predetermined controlled sequence to produce a plurality of pulsed radiation beams in a scan pattern which are adapted to scan the article counting stage in a predetermined controlled scan pattern.

A still yet further advantage of the present invention is that the radiation receiving means can utilize semiconductor devices which are responsive to the frequency of the radiation source and to the radiation pulses reflected from the articles to be counted. The semiconductor devices, in turn, produce pulse signals which are applied to an amplifier which likewise has a pulsed output. The pulsed signal from the amplifier is utilized as an input to a pulse detector which is responsive to the pulsed signals to produce an output analog signal indicative of the characteristics of the reflected radiation pulse received by the radiation pulse receiving means. The output analog signal can be applied to a threshold detector circuit which is adapted to compare the same against a reference level and, provided that the output signal exceeds the reference level, to produce an output signal indicative of an article to be counted.

A still yet further advantage of the present invention is that each of the threshold detector circuits from each of the radiation pulse receiving means can be applied to a discrimination logic circuit which is responsive to all of the output signals representing articles to be counted and which is responsive to the first received radiation pulse output signal produced by an article intercepting at least two pulsed, radiation beams and to utilize the first received radiation pulsed output signal as a means for producing a count signal and for responding to a later received but higher amplitude and/or duration radiation pulsed output signal from the same article to produce and pass the subsequent count signal while inhibiting the count signal from the same article.

A still yet further advantage of the present invention is that the threshold detecting circuit can be automated such that the analog output signal of the peak detector can be sampled and held and to permit the threshold detector circuit to vary the comparative reference level voltage as a function of the geometrical dimension of the articles being passed through the article counting stage so as to permit the apparatus to count articles having acceptable variations in diameter.

DESCRIPTION OF THE DRAWING

These and other objects and advantages of the present invention will become more apparent when considered in view of the description of the preferred embodiment taken together with the drawing wherein.

DESCRIPTION OF THE PREFERRED EMBODIMENT

Figure 1:
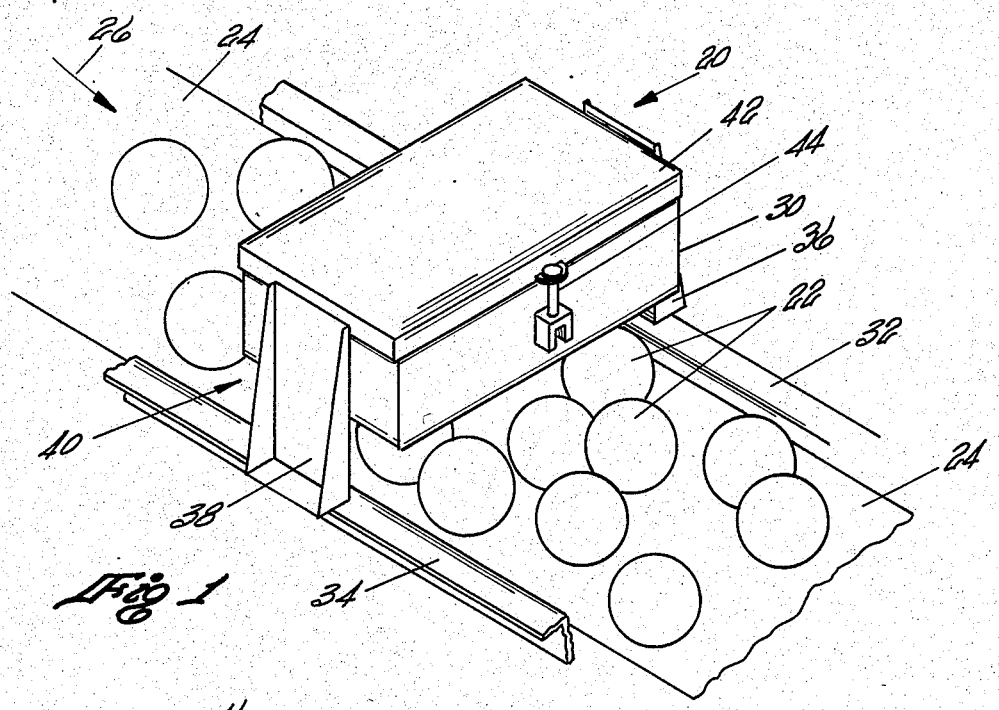
FIG. 1 is a perspective view of a conveyor line having articles traveling therealong in a random pattern along a predetermined path and in a selected direction and passing through an article counting stage having apparatus for counting the articles which utilizes the teachings of the present invention.

FIG. 1 illustrates one embodiment of the apparatus for counting articles which is the subject of this invention. In the embodiment illustrated in FIG. 1, the apparatus for counting articles is shown generally by arrow 20. The apparatus is adapted for counting articles such as citrus fruit shown generally as 22 which are travelling in a random pattern along a predetermined path and in a selected direction. In the embodiment of FIG. 1, the articles to be counted, which may be for example lemons, are transported by an endless belt conveyor 24 along a predetermined path shown by arrow 26. The conveyor 24 defines a predetermined path over which the articles 22 are to be conveyed. Means are positioned along the predetermined path of the conveyor 24 for defining an article counting stage. In the embodiment illustrated in FIG. 1, the article counting stage is defined by the area located between a housing 30 and the conveyor 24. The housing 30 is positioned above the conveyor 24 by "L" shaped support brackets 32 and 34 and upright supports 36 and 38 which extend from the "L" shaped support brackets 32 and 34, respectively. Thus, the area shown generally as arrow 40 is the article counting stage which is adapted to have the articles 22 passed there through. In use, articles are deposited on or conveyed by the conveyor 24 in a random pattern and the articles 24 maintain a random pattern as they are conveyed along the predetermined path by conveyor 24 and in the direction shown by arrow 26.

In the embodiment illustrated in FIG. 1, the housing 30 includes means which are adapted for producing a plurality of pulsed, spaced, parallel beams of radiation in a scan pattern which is directed into the article counting stage. Each of the articles is adapted to intercept, with a selected portion of the article, two or more of the plurality of pulsed, spaced parallel beams of radiation. In the embodiment illustrated in FIG. 1, the pulsed, spaced parallel beams of radiation are intercepted by a selected portion of the articles 22 which are passing through the article counting stage 40. Each of the selected portions of the article 22 reflect therefrom a pulse of radiation. Each pulse of radiation is reflected along a different reflection path where the pulse of radiation is received by a radiation pulse receiving means likewise located within the housing 30. The housing 30 includes a cover 42 which is held in place by a connector means 44. The pulse producing means, the radiation pulse receiving means and control circuitry are all located within the interior of the housing 30. Access to the electronic circuitry can be obtained by loosening clasp 44 and lifting the cover 42.

The apparatus illustrated in FIG. 1 is self-contained and can be positioned on any conveyor line so as to result in the counting apparatus having a wide degree of flexibility and adapted for use with one or more conveyor lines. The length and width of the "L" shaped support brackets 32 and 34, and the shape and height of the uprights 36 and 38 can be varied to position the housing 30 in an appropriate relationship with the conveyor so as to have sufficient height between the housing 30 and the surface of the conveyor 24 so that the articles to be counted can pass beneath the housing 30.

Figure 2:
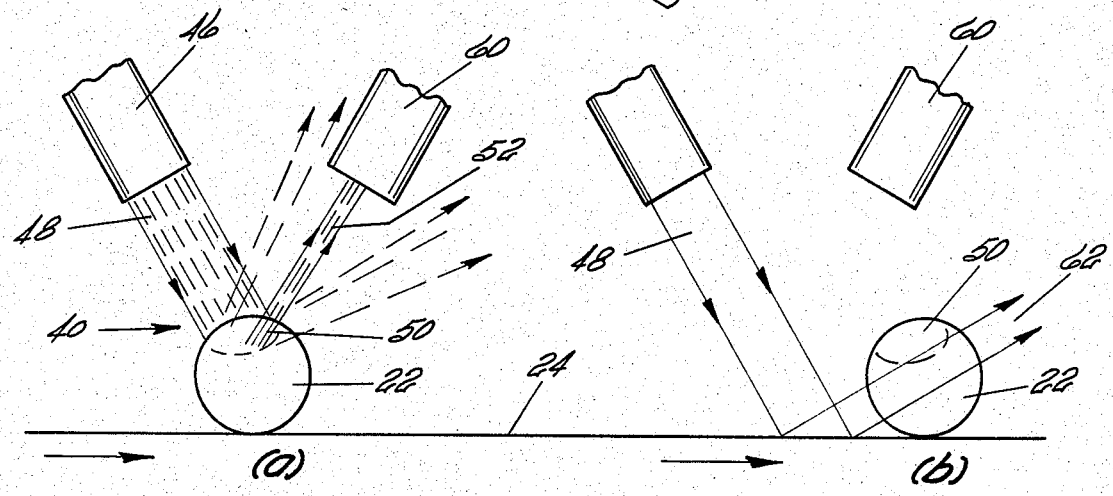
FIGS. 2(*a*) and 2(*b*) are pictoral representations of an article intercepting a pulsed, radiation beam and reflecting therefrom a radiation pulse along a reflection path.

FIGS. 2(*a*) and 2(*b*) illustrate diagramatically the relationship between article 22 as it passes through the article counting stage 40.

As illustrated in FIG. 2(*a*), a means for producing a pulsed parallel beam of radiation, such as for example, an infrared light emitting diode 46 produces a pulsed parallel beam of radiation illustrated by beam 48 which is directed along a selected scan path into the article counting stage 40. In this embodiment, the pulsed, parallel beams of radiation are directed at a selected angle into the article counting stage so as to be intercepted by a selected portion 50 of an article 22. The selected portion 50 of article 22 reflects therefrom a pulse of radiation illustrated by beam 52 which travels along a reflection path and is received by a radiation pulse receiving means 60. A portion of the intercepted beam 48 scatters or is deflected along an angle which may exceed the sector angle over which the pulse radiation receiving means 60 is adapted to receive the pulse. The relationship between the portion of the reflected radiation pulse actually received by the pulse radiation receiving means 60 and the portion of the reflected pulse which is scattered and not intercepted by the radiation pulse receiving means 60 determines the level of the output pulses ultimately produced by the circuitry. In the example illustrated in FIG. 2(*a*), a sufficient portion of the reflected radiation pulse 52 is received by the radiation pulse receiving means 60 to produce a count.

As illustrated in FIG. 2(*a*), only a single pulsed radiation beam is illustrated to be intercepted by selected portion 50 of the article 22.

In the apparatus illustrated in FIG. 1, a plurality of light emitting diodes, which function as the means for producing the plurality of pulsed, spaced parallel beams of radiation are arranged in a aligned array which are pulsed in a predetermined manner to produce a plurality of pulsed radiation beams such that the distance between each adjacent pulsed radiation beam is selected relative to the geometrical dimension of the article 22 the relationship is such that the article 22 intercepts two different pulsed, spaced radiation beams, with two different selected portions of the article 22, to produce two or more reflected radiation pulses 52 which are likewise received by a plurality of aligned radiation pulse receiving means 60.

FIG. 2(*b*) illustrates the article 22 being transported past the pulsed beam of radiation 48 such that the selected portion 50 of article 22 does not intercept the beam 48. In that event, the radiation pulse receiving means 60 does not receive a reflected pulse. Thus, the radiation pulse intercepts the surface of the conveyor 24 which, in turn, produces a reflected beam 62 which diverges from and is not received by the radiation pulse receiving means 60.

Figure 3:
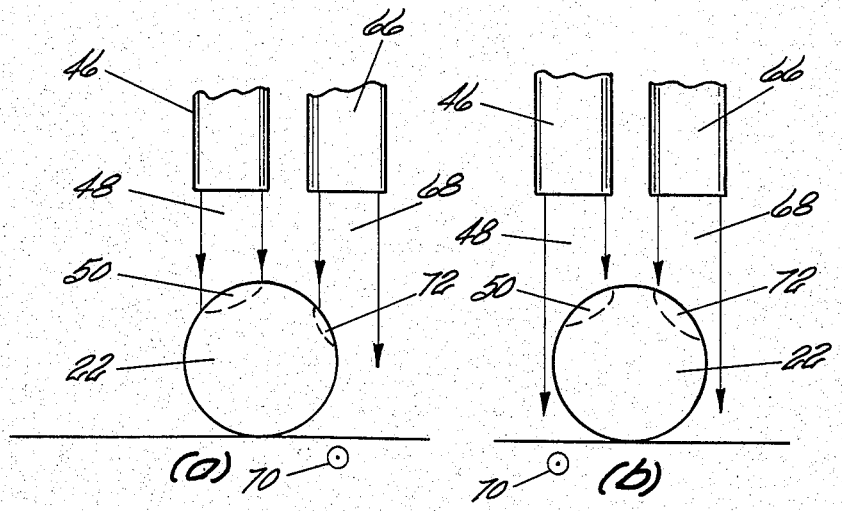
FIGS. 3(*a*) and 3(*b*) are pictoral representations of an alternate embodiment of the apparatus wherein the article is transported past two radiation sources each of which produce a pulsed, parallel radiation beam which is intercepted by a selected portion of the article which reflects the same along a reflection path.

FIGS. 3(*a*) and 3(*b*) illustrate in a front view two spaced, aligned means for producing pulsed, spaced parallel beams of radiation which are identified as 46 and 66. The first radiation source 46 produces a pulse beam 48 while the second radiation source 66 produces a second pulse beam 68. The article 22 is being transported along the conveyor line towards the viewer as shown by arrowhead dot 70. In operation, the first radiation pulse source 46 is fired by a triggering pulse to produce a radiation beam 48 which intercepts selected portion 50 of article 22 to produce a reflected radiation pulse, such as that illustrated as reflection pulse 52 in FIG. 2(*a*). Shortly thereafter, the second pulsed radiation beam source 66 is triggered at a predetermined time interval after the first pulsed radiation source 46 is triggered to produce a second radiation beam 66 a portion of which intercepts a second selected portion 72 of article 22. Thus, as an article 22 is passed beneath two adjacent means for producing pulsed, spaced parallel beams of radiation, the physical relationship therebetween is such that at least two selected portions of the article 22 intercept two adjacent beams in the scan pattern such that each article is adapted to have at least two selected portions thereof independently intercept at least two beams of radiation and to reflect therefrom at least two pulses of radiation along different reflection paths.

FIG. 3(*b*) shows the article 22 being substantially centered relative to the first radiation source 46 and the second radiation source 66. Thus, when the first radiation source 46 is pulsed to produce radiation pulse 48, the selected portion 50 will intercept a substantial portion of the radiation beam 48 to produce a reflected pulse such as that illustrated as radiation pulse 52 in FIG. 2(*a*). Also, a second selected portion 72 of the article 22 would intercept the second produced pulsed, spaced parallel beam of radiation 68 to produce an independent second reflected radiation pulse therefrom which travels along a different reflection path to its associated radiation pulse receiving means.

In this embodiment, the amplitude of the reflected radiation pulses may differ due to the physical location of the object relative to the radiation pulse receiving means. If the first generated reflected radiation pulse is of greater amplitude and/or duration then the subsequently generated reflected radiation pulses, the discrimination logic operates in a predetermined manner to pass a count signal from the first received reflected radiation pulse. However, if the later received reflected radiation pulse signal is of greater amplitude, the discrimination logic will inhibit the count signal from the first received reflected radiation pulse and pass a subsequent count signal generated from the subsequent received reflected radiation pulse.

Figure 4:
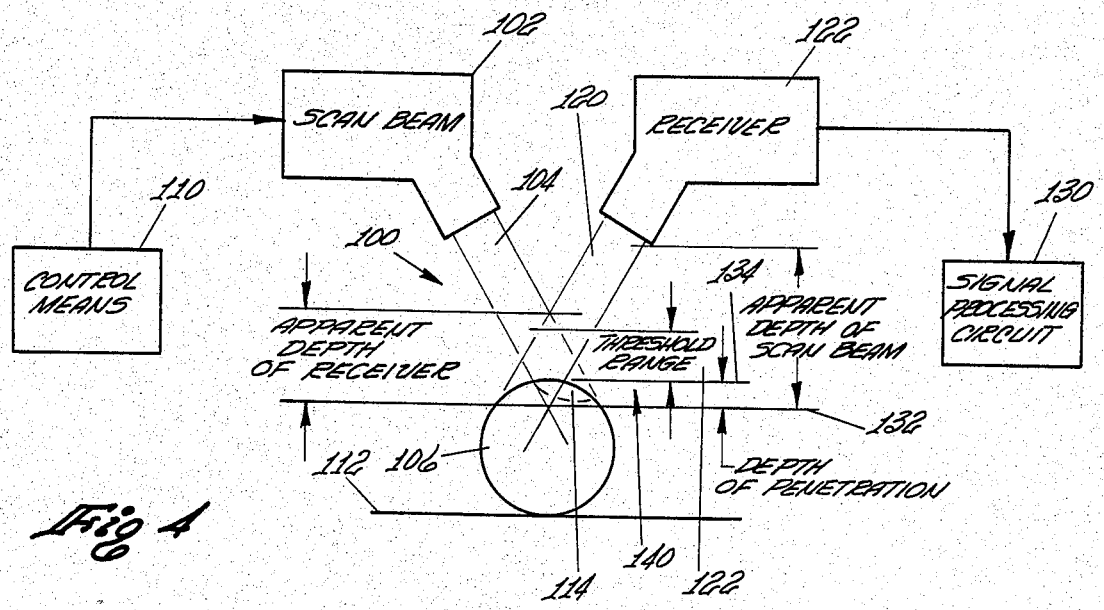
FIG. 4 is a pictoral representation of the control means, a scan beam source, a receiver and signal processing circuitry wherein the pulsed, radiation beams and the article which intercept the radiation beam to produce the radiation pulse.

FIG. 4 illustrates diagramatically the apparatus illustrated generally as 20 of FIG. 1 and located within the housing 30. The apparatus for counting articles includes a means positioned relative to the article counting stage, illustrated generally as 100, and includes a means for producing in a scan pattern thereacross a plurality of pulsed, spaced parallel FIG. 3(*b*) shows the article 22 being substantially centered relative to the first radiation source 46 and the second radiation source 66. Thus, when the first radiation source 46 is pulsed to produce radiation pulse 48, the selected portion 50 will intercept a substantial portion of the radiation beam 48 to produce a reflected pulse such as that illustrated as radiation pulse 52 in FIG. 2(*a*). Also, a second selected portion 72 of the article 22 would intercept the second produced pulsed, spaced parallel beam of radiation 68 to produce an independent second reflected radiation pulse therefrom which travels along a different reflection path to its associated radiation pulse receiving means.

In this embodiment, the amplitude of the reflected radiation pulses may differ due to the physical location of the object relative to the radiation pulse receiving means. If the first generated reflected radiation pulse is of greater amplitude and/or duration then the subsequently generated reflected radiation pulses, the discrimination logic operates in a predetermined manner to pass a count signal from the first received reflected radiation pulse. However, if the later received reflected radiation pulse signal is of greater amplitude, the discrimination logic will inhibit the count signal from the first received reflected radiation pulse and pass a subsequent count signal generated from the subsequent received reflected radiation pulse.

FIG. 4 illustrates diagramatically the apparatus illustrated generally as 20 of FIG. 1 and located within the housing 30. The apparatus for counting articles includes a means positioned relative to the article counting stage, illustrated generally as 100, and includes a means for producing in a scan pattern thereacross a plurality of pulsed, spaced parallel beams of radiation which is generally shown as a scan beam 102. Each of the pulsed, spaced parallel beams of radiation produced from the scan beam 102, of which radiation beam 104 is typical, is directed along a scan path into the article counting stage 100. Each individual scan beam is adapted to be intercepted by a selected portion of the article, such as article 106 having a selected portion 114 passing through the article counting stage 100. The position of the scan beam 102, the scan pattern to be traversed by the radiation beam 104 and the diameter of the radiation beam 104 are all factors in determining the size of the article which can be counted by the counting apparatus. Thus, if an article 106, which is illustrated in FIG. 4 to be spherical in shape, has a known geometrical dimension, the angle of the scan pattern, the diameter of the radiation beam 104 and the position of the scan beam 102 relative to the article counting stage is selected to have an apparent depth of penetration into the interior of the article 106. For example, if a larger article is to be counted by the counting apparatus, the angle of the scan pattern 104 may be adjusted to raise the apparent depth of penetration so as to accomodate a larger article. The operation of the scan beam 102 is controlled by a separate control means shown as 110. In the preferred embodiment, the control means 110 programs the scan beam 102 to produce the plurality of pulsed, spaced parallel beams of radiation at a predetermined pulse rate such that a scanning beam is produced which traverses the conveyor 112 and which is responsive to an article 106 being transported by the conveyor 112 so as to intercept the radiation beam 104 which is positioned so as to intercept the selected portion 114 of article 106.

When a radiation beam 104 intercepts a selected portion 114 of an article 106, a reflected radiation pulse is produced which is illustrated by pulse 120 which travels along a reflection path which is essentially at an acute angle relative to the scan path of the radiation beam 104. The reflected radiation pulse is received by a radiation pulse receiving means shown as receiver 122. Each pulsed, spaced parallel beam of radiation has its associated radiation pulse receiving means such that a reflected radiation pulse can be received in a time sequence which is determined by the pulse rate of the scan beam 102 and the location of the selected portion of the article 106 intercepting the beam 104.

The angle or sector of radiation which can be received by the receiver 122 intercepts the radiation beam diameter to develop a threshold range, which is illustrated by threshold range 122, such that articles 106 can have a variance in geometrical dimension which is within the threshold range and that article would be counted.

The radiation pulse receiver 122 has logical circuitry which produces an output signal which is applied to a signal processing circuitry 130.

As illustrated in FIG. 4, the difference between the apparent depth of the scan beam and the apparent depth of the receiver, which is illustrated by line 132 and the lower end of the threshold range, as illustrated by line 134 results in a depth of apparent penetration 140 into the interior of the article 106. As the size of the article 106 increases further into the threshold range 122, the apparent depth of penetration would increase due to the relative angle between the radiation beam 104 and the sector angle of the receiver 122 which is capable of receiving the reflected radiation pulses 120.

Figure 5:
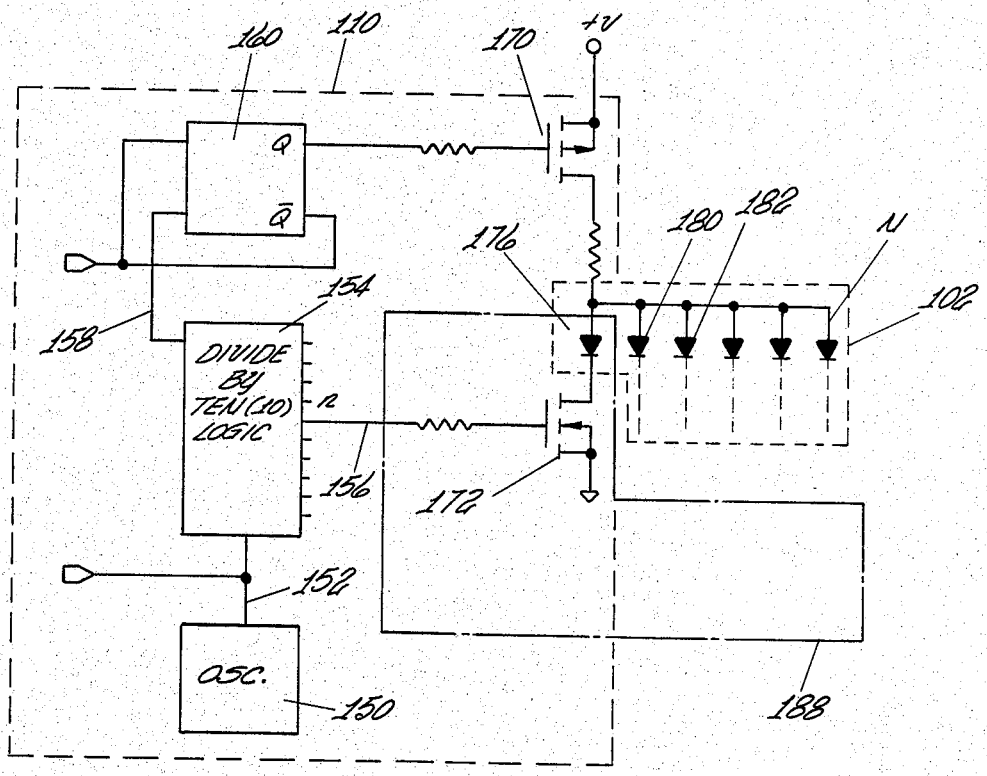
FIG. 5 is a circuit which includes a means for producing output pulses and for deriving therefrom trigger pulses which are utilized to actuate a driving means for firing infrared light emitting diodes which are utilized as the source of the pulsed, parallel spaced radiation beams for the present invention.

FIG. 5 illustrates electrical circuitry for the control means 110 and the scan beam 102 illustrated in FIG. 4. Specifically, the components which comprise the control means 110 are enclosed within the dash line 110. The infrared light emitting diode array which form the scan beam 102 of FIG. 4 is enclosed by a dotted box 102 in FIG. 5.

In FIG. 5, the control means 110 includes an oscillator 150 which has a frequency in the order of 2 to 10 kilohertz. An output 152 of oscillator 150 applies the output signal of the oscillator 150 to a divide-by-ten logic 154. The output of the divide-by-ten logic performs two functions; first, one output which appears on output 156 is utilized as a trigger pulse for a stage "N" input to the driving means for one stage of the scan beam 102 as will be further explained hereinafter; and (2) the other output of the divide-by-ten logic appears on output 158 which is utilized as an input into a flip-flop 160 which is adapted to apply a source of voltage to a field effect transistor voltage switch 170 which has a sufficient magnitude to fire the infrared light emitting diode array illustrated as 102.

The output appearing on lead 156, which is typical of an output from the divide-by-ten logic 154, is a trigger pulse which is applied to a field effect transistor (FET) buffer drive circuit 172 which is capable of firing the infrared light emitting diode 176 to produce a pulse parallel beam of radiation. The infrared light emitting diode array which forms the scan beam 102 can have a plurality of spaced infrared light emitting diodes of which 176, 180, 182 and "N" are typical. Each infrared light emitting diode of the array would have its own associated FET buffer drive circuit, of which FET circuit 172 is typical. Each FET buffer drive circuit 172 would have a trigger pulse applied thereto. However, the divide-by-ten logic 154 would apply the trigger pulses in a staggered arrangement to the FET buffer drive circuit which results in each individual infrared light emitting diode such as for example diodes 176, 180, and 182, producing a pulsed parallel beam of radiation where the timing between each of the pulses is determined by the time differential between each staggered trigger pulse applied to a respective FET buffer drive circuit by the divide-by-ten logic 154. In the preferred embodiment, the infrared light emitting diode array comprises 10 single light emitting diodes and each diode has its own FET driver of which the circuitry illustrated by the dot-dash box 188 is typical.

In the event a second infrared light emitting diode array is utilized across a wider conveyor line, the divide-by-ten logic 154 has an output which is adapted to trigger sync a second infrared LED array for the wider conveyor line. Thus, by appropriate interconnecting of the divide-by-ten logic 154 in two or more arrays of ten infrared light emitting diodes, the transmitter control means can fire 1 to 20 infrared light emitting diodes in either a staggered or syncronized relationship. The trigger pulses produced by the divide-by-ten logic 154 can be envisioned to be applied to the infrared light emitting diode array so as to cause a ripple firing of the LEDs which permits objects to intercept two separate beams which are phased relative to each other such that the reflected radiation pulses can likewise be received by the radiation pulse receiving means to develop a spatial time sequence between two adjacent radiation pulses reflected from the same article by the use of staggered trigger pulses to control the firing sequence of the infrared light emitting diode array.

Figure 6:
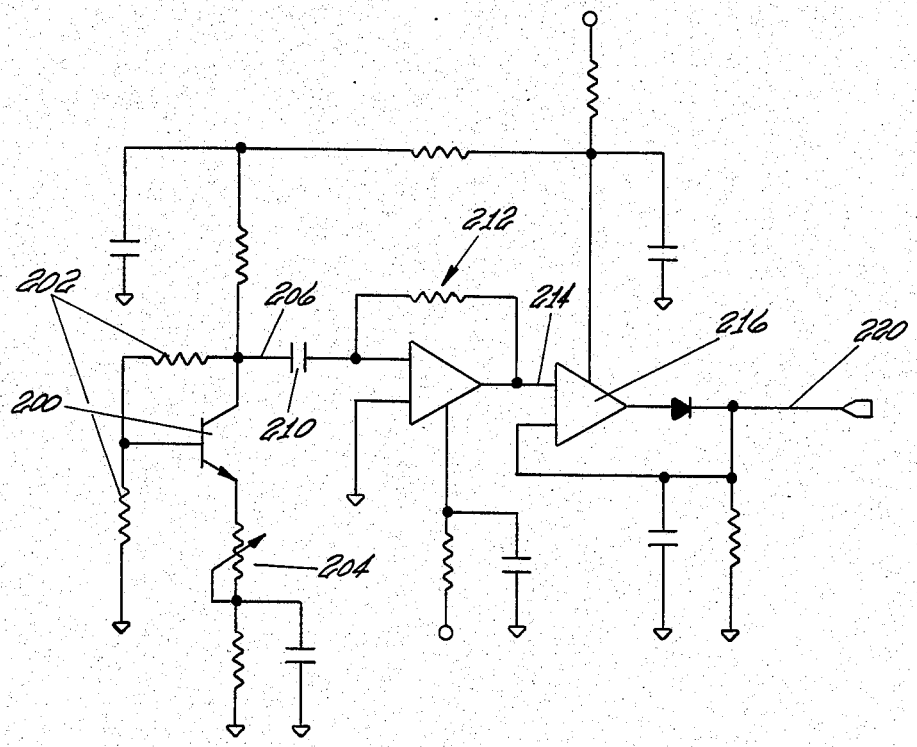
FIG. 6 is a schematic diagram of one embodiment of a radiation pulse receiving means for receiving the radiation pulse and for producing therefrom an output analog signal.

FIG. 6 illustrates one embodiment of a receiver circuit which is adapted to function as a receiver 122 illustrated in FIG. 4. The radiation pulse receiver includes a phototransistor 200 which includes and is part of a self-biasing circuit 202 and which includes a gain adjusting means 204. The phototransistor 200 is responsive to the radiation pulse, or absent of a radiation pulse, to produce an output pulse which would appear across the collector of the phototransitor 200 which is output 206. The phototransistor 200, through its self-biasing circuit 202, inhibits the phototransistor detector from saturating with a normal direct current background. A direct current background can be generated in the counting apparatus from a light source, which may either be an incandescent lamp or can be direct sunlight. Either of these sources can be utilized because they are high in infrared energy and the phototransistor 200 can be biased based upon such background light sources. The balancing circuit 204 is included in each phototransistor self-biasing stage to permit balancing of all the receiver phototransistors such as the same have the same gain and the output levels for all receivers are matched to the respective transmitters.

The output of the phototransistor 200 appears across output 206 and is AC coupled through capacitor 210 to a current mode amplifier shown generally as 212. The current mode amplifer 212 produces a pulse output which appears on lead 214, which, in turn, functions as an input to a peak detector 216. The peak detector 216 reassembles the pulse signal received on input 214 from the current mode pulse amplifier 212 to produce an analog output signal which appears on output 220.

Each stage of the radiation pulse receiving means would have a similar circuitry such that an analog output signal is produced by each separate radiation pulse receiving means and the plurality of output analog signals are then further processed as described hereinafter.

Figure 7:
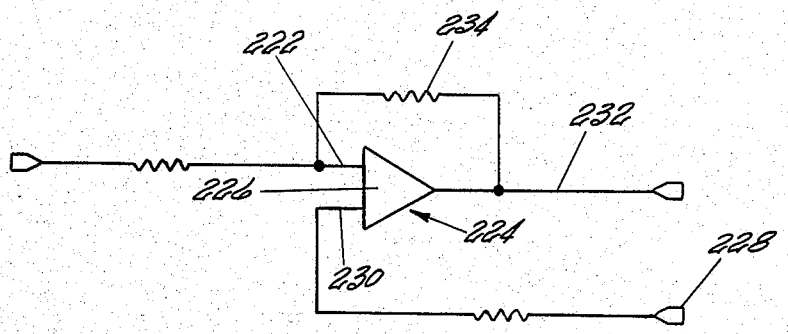
FIG. 7 is a schematic diagram of one embodiment of a threshold detector for receiving the output analog signal, for comparing the same to a reference level and for producing an output signal if the output analog signal exceeds the reference level.

Each output of the peak detector 216, such as the analog output signal 220 from peak detector 216 as illustrated in FIG. 6, is utilized as an input on an input 222 of a threshold detector circuit generally illustrated as 224. The threshold detector 224 illustrated in FIG. 7 is a dynamic or fixed type threshold detector circuit which includes an operational amplifier 226 which has two inputs, the output analog signal applied thereto by input lead 222 and a reference level voltage from a voltage reference source 228 which is applied as a second input to the operational amp 226 as illustrated by input 230.

The peak detector 224 compares the input signal on input lead 222 to the voltage from the reference which appears on lead 230. If the analog signal appearing on lead 222 has a voltage level which is greater than the voltage of the refenece level appearing on lead 230, the output 232 of the operational amplifier 226 increases in voltage. The voltage appearing on output 232 is applied via a feedback resistor 234 to and is added to the analog signal on lead 222. This has the effect of further increasing the voltage level of the signal appearing on output 232. When the signal appearing on input 222 decreases in amplitude, that decrease must be at least by one volt. Thus, when the input signal appearing on lead 222 decreases in amplitude, it must decrease by at least one volt. The variance between the peaks and the valleys of the output signal appearing on output 232 is utilized as a ripple factor for the peak detector ramping. The ripple factor can be utilized in an automatic detector circuit, which is illustrated in detail in FIGS. 17 and 18, so as to increase the versitility of the counting apparatus.

Figure 8:
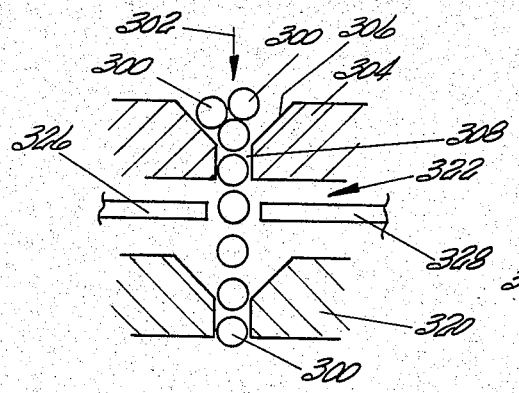
FIG. 8 is a pictoral representation of another embodiment of a radiation source and a pulse receiving means for responding to an article falling as a thin web through an article counting stage.
Figure 9:
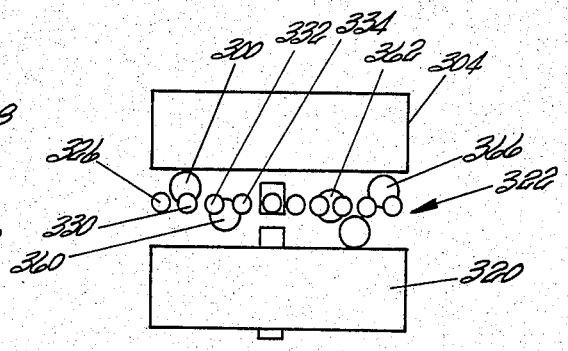
FIG. 9 is a front view of the embodiment of FIG. 8 illustrating the arrangements of the infrared light emitting diodes such that an article intercepts at least two beams of radiation.

FIGS. 8 and 9 illustrate another embodiment of an apparatus for counting articles which operates on the principle of pulse interruption by the articles. In FIG. 8, the articles may be small objects such as for example pills which are generally illustrated by 300. The pills may be transported by an airstream or other conveying means along a predetermined path in any selected direction as illustrated by arrow 302. The small objects 300 are then formed into a thin web of articles by a converging means such as for example a housing 304 which defines a hopper 306 having an outlet 308 which extends from the bottom thereof. The outlet 308 is elongated such that the objects 300 fall in a random pattern there through.

A second housing 320 defines a second hopper and outlet which are located further along the predetermined path 302 and functions to further direct the objects 300 along the predetermined path.

A spacing exists between the housing 304 and the housing 320 which defines an article counting stage shown generally as 322. In the embodiment illustrated in FIG. 8, the pulsed parallel beams of radiation can be produced from a radiation source and transmitted into the article counting stage 322 by a infrared light conducting means such as for example, a fiber optic element 326. The fiber optic element 326 directs the pulsed, spaced parallel beam through the article counting stage 322 so as to intercept the objects 300 following along the predetermined path 302, which objects likewise pass through the article counting stage 322. A second fiber optic element such as for example fiber optic element 328 in combination with a radiation source can be utilized to sense the presence and absence of the radiation beam. In the embodiment illustrated in FIG. 8, in the absence of an object intercepting the beam, the fiber optic element 328 would receive a radiation pulse, the duration of which would be terminated by a selected portion of an article 300 intercepting the radiation beam from the fiber optic element 326. However, the inherent relationship still exists between the objects and the radiation pulses; that is, that the spacing between each adjacent spaced pulse radiation beam is such that the object would have at least two selected portions thereof intercept the two adjacent beams.

This physical relationship is illustrated in greater detail in FIG. 9. The housing 304 and 320 are likewise illustrated and the fiber optics for producing the plurality of pulsed spaced radiation beams are shown as 326. The object to be counted, such as object 300 pass in a random pattern through the article counting stage 322. Article 300 is shown in a position so as to be off-centered relative to fiber optic elements 326 and 330, but object 300 has at least two selected portions thereof which intercept the beams produced by fiber optic elements 326 and 330.

A second object 360 is illustrated to be centered relative to two adjacent fiber optics 332 and 334. In a similar manner, at least two selected portions of article 360 intercept the 360 intercept the pulse, spaced radiation beams scanning in a scan pattern across the article counting stage 322. Other objects shown as 362 and 366 likewise intercept other radiation beams which likewise may be applied to the counting stage to fiber optic elements.

Figure 10:
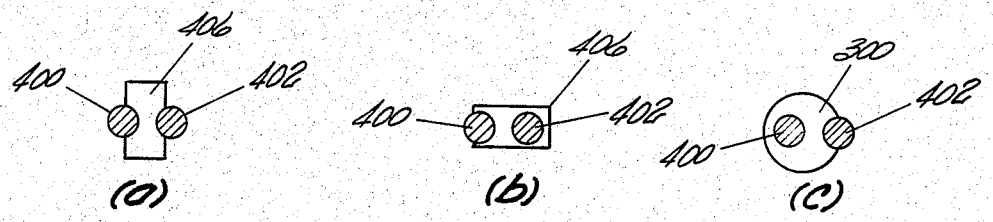
FIGS. 10(*a*), 10(*b*) and 10(*c*) are pictoral representations of how an article depicted in FIGS. 8 and 9 would be counted as it falls through the article counting stage.

FIGS. 10(*a*), 10(*b*) and 10(*c*) show three different examples of objects having different geometrical shapes and the relationship between the geometrical dimension of the object and the spacing between each adjacent pulse radiation beam to be intercepted thereby.

For example, FIG. 10(*a*) shows two radiation beams 400 and 402 which are adapted to be intercepted by two selected portions of a square shaped article 406.

FIG. 10(*b*) shows the same article 406 which has been rotated 90° which likewise intercepts the two spaced parallel pulse radiation beams 400 and 402.

FIG. 10(*c*) shows a circular shaped object 300 intercepting the same two, spaced radiation beams 400 and 402.

Figure 11:
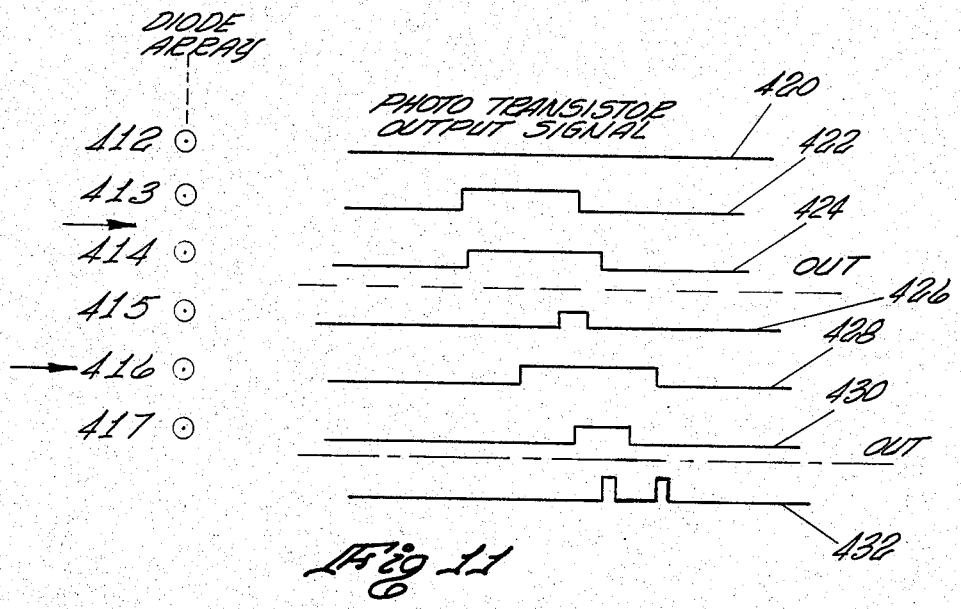
FIG. 11 are typical waveforms produced by adjacent stages of the radiation pulse receiving means circuitry illustrated in FIG. 6 in response to two different articles intercepting the pulsed radiation beams.

FIG. 11 is an example of the pulses produced by an object intercepting two beams as illustrated in FIGS. 3(*a*) and 3(*b*). In FIG. 11, a diode array comprising six infrared light emitting diodes are positioned in aligned space relationship in the diodes numbered by elements 412 to 417, inclusive. In the example illustrated in FIG. 11, an object, such as object 22 illustrated in FIG. 3(*a*), is assumed to be positioned on the conveyor 24 such that the radiation pulse produced from diode 412 is not intercepted by the article 22. In such event, the phototransistor output signal, which would be the signal appearing at output 206 in FIG. 6, would be at a level output which indicates that the radiation pulse receiving means did not receive a pulse.

The radiation pulses produced in a sequence by infrared light emitting diodes 413 and 414, which corresponds to the position of the article 22 in FIG. 3(*b*), are intercepted by the article such that both radiation pulses are almost intercepted equally such that two reflected radiation pulses are produced, but which are in a timed spatial sequence relative to each other. Thus, the radiation pulse from infrared light emitting diode 413 is intercepted by a selected portion of article 22, such as for example selected portion 50 to produce an output pulse as illustrated by waveform 422. The second selected portion of article 22, such as for example, selected article 72 illustrated in FIG. 3(*b*), is pulsed by and intercepts the second spaced parallel radiation beam a short time later and the output of infrared light emitting diode 414 is illustrated by waveform 424 which has a longer duration than waveform 422. In the diagram of FIG. 11, the output signal produced by the phototransistor output is illustrated by curve 422 and is the first received radiation pulse output signal which occurs at time $t_1$. The later received radiation pulse output signal represented by curve 424 has its leading edge occuring at time $t_2$ which is spaced from and in a timed sequence with the leading edge of the first received output radiation pulse presented by waveform 422—since the pulse represented by the waveform is of longer duration.

In FIG. 11, infrared light emitting diodes 415, 416 and 417 are assumed to be intercepted by three selected portions of an article to produce three separate output signals illustrated by waveforms 426, 428 and 430. In the three wave forms, wave form 428, by the physical position of the article 22, intercepts the radiation beam from radiation source 416 but produces a reflected radiation pulse which is received by its associated radiation pulse receiving means at an earlier time than the pulse evidenced by waveform 426 which is a radiation pulse received from the earlier triggered radiation beam from diode 415. Again, the first received radiation pulse is important in that the output signals produced by the other radiation pulse receiving means likewise could indicate the existence of a count.

Figure 14A:
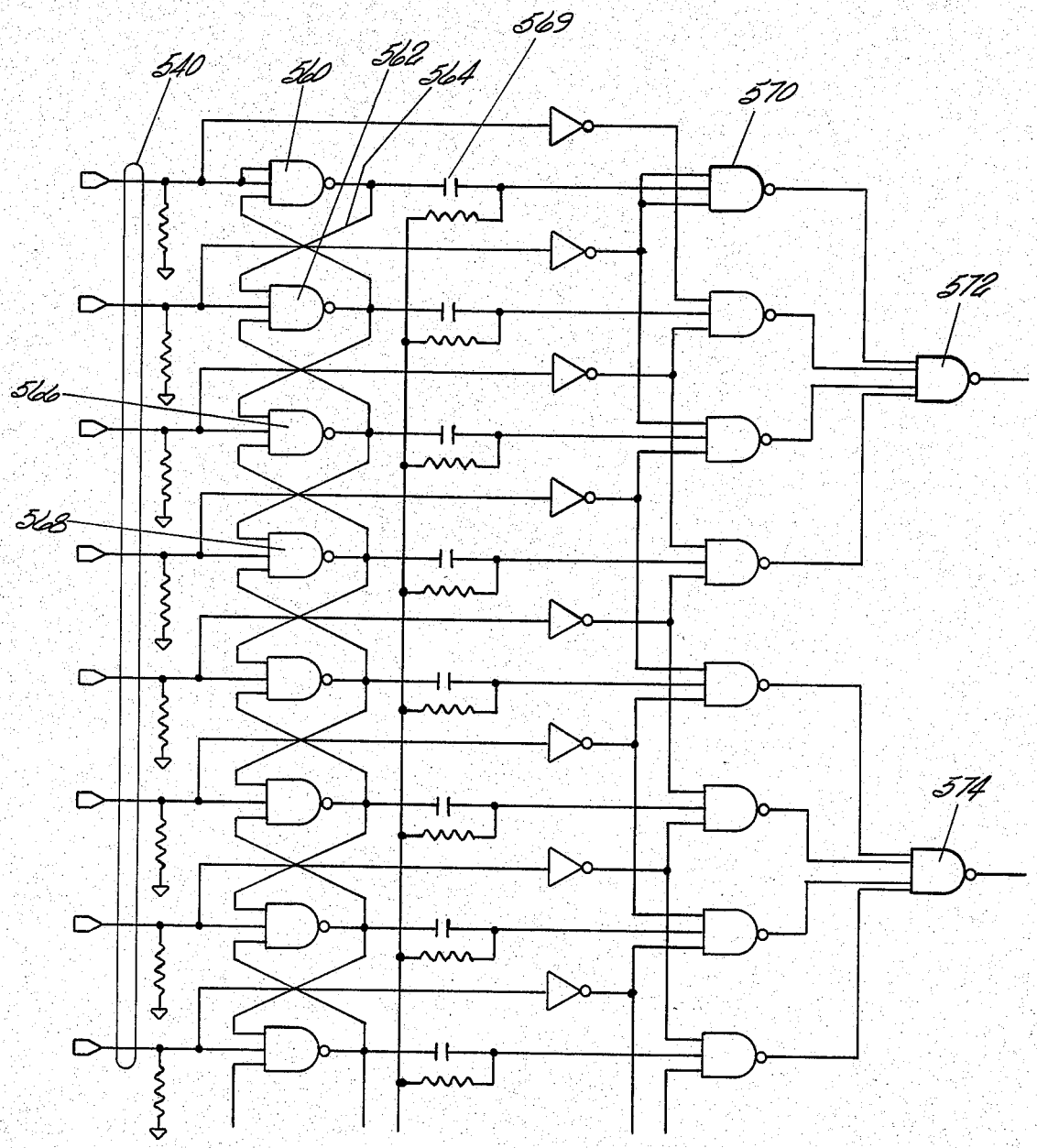
FIGS. 14(*a*) and 14(*b*) illustrate schematically the discrimination logic which is responsive to the threshold detector output signals to determine and pass count signals produced in response to a received radiation pulse.
Figure 14B:
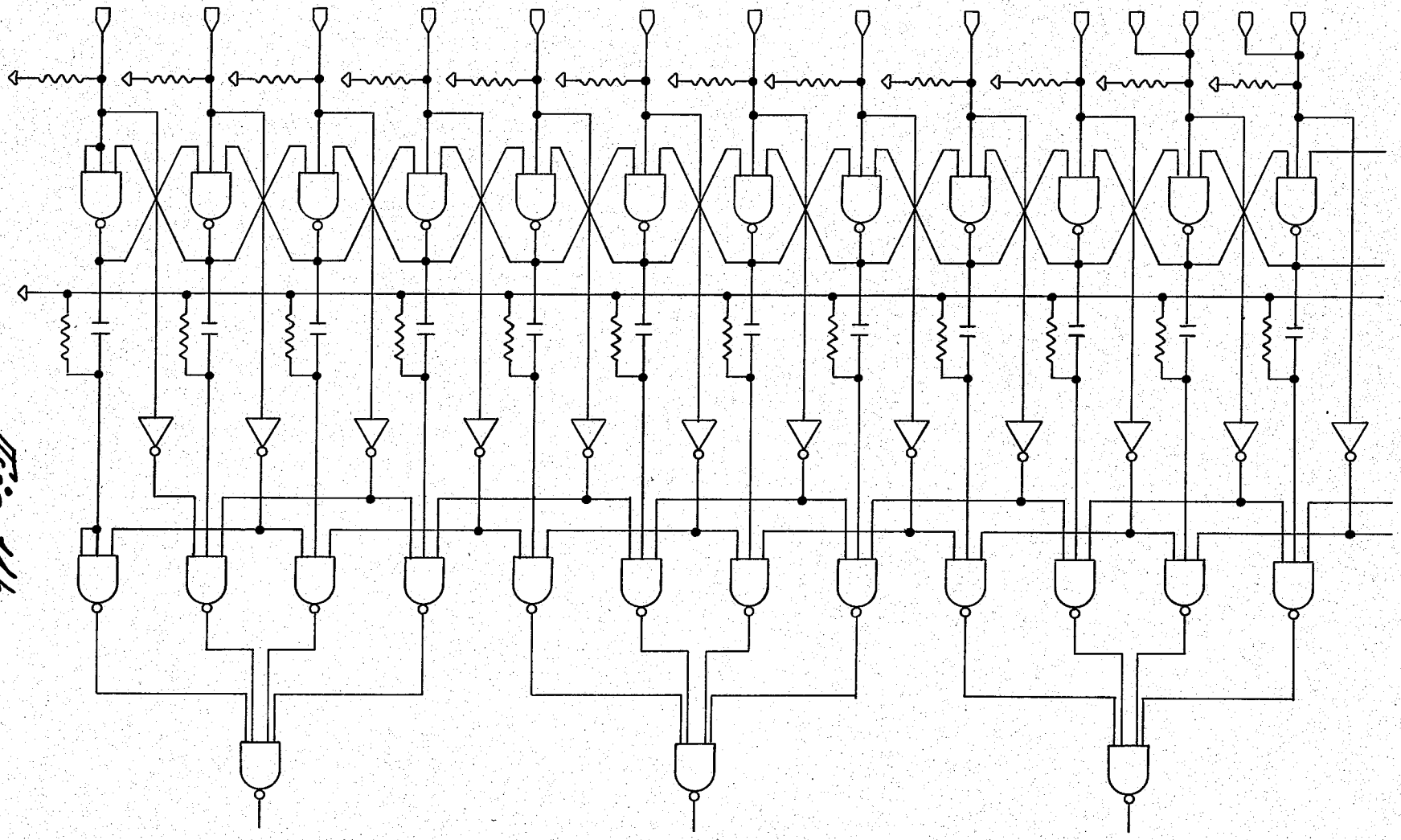

The discrimination logic, which is illustrated in FIGS. 14(*a*) and 14(*b*) perform the function of discriminating between each of the pulses to ultimately produce an accumulated count pulse train such as that illustrated by waveform 432 in FIG. 11.

Figure 12:
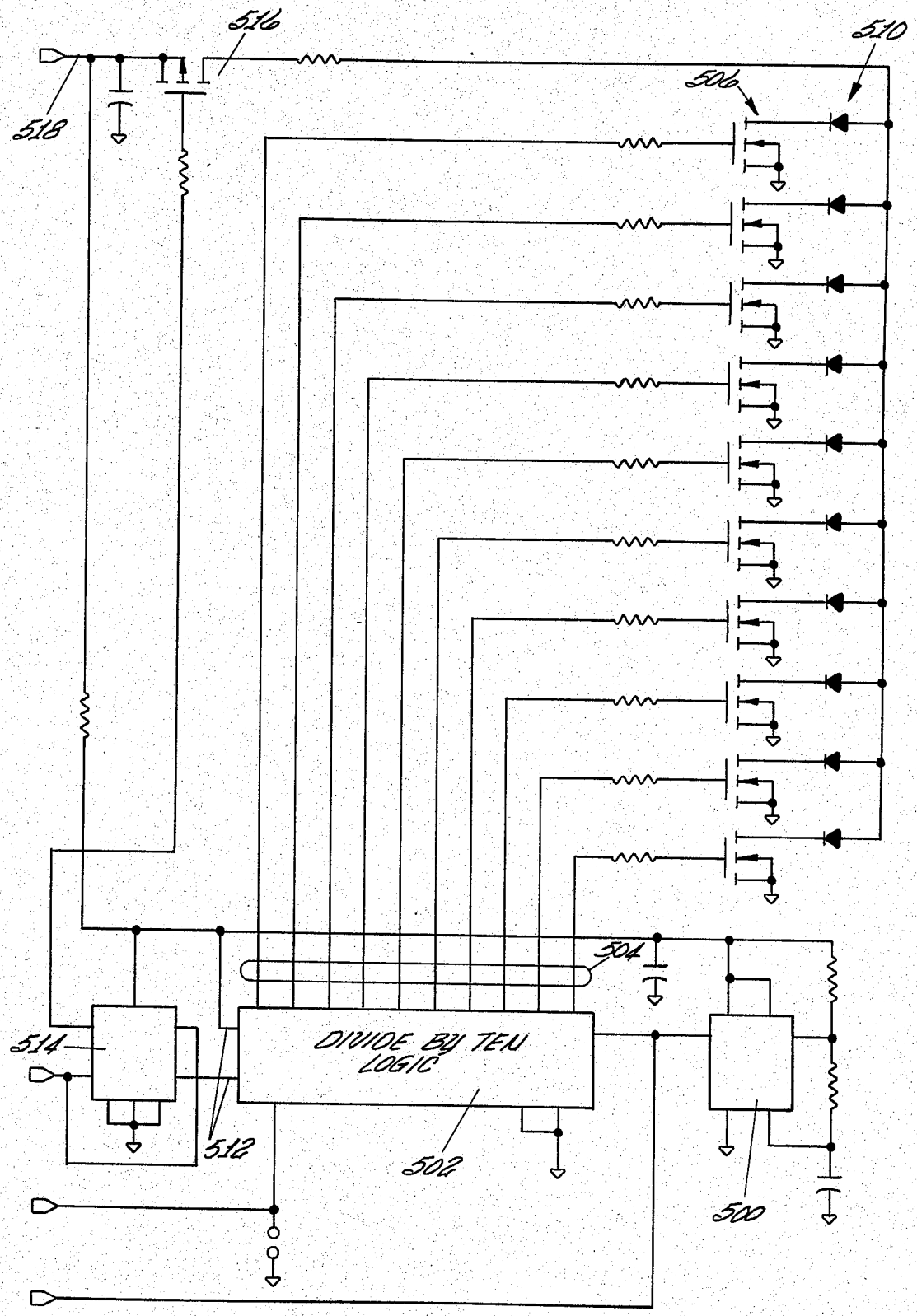
FIG. 12 is a schematic diagram representing the radiation beam producing means including an oscillator, frequency dividing means for producing triggering pulses, field effect transistor driving means and the LED array.

FIG. 12 illustrates one embodiment of a control means and a infrared light emitting diode array having 10 infrared light emitting diodes. An oscillator 500 produces an output signal which is applied to a divide-by-ten logic circuit 502 which has a plurality of outputs 504 which produce a plurality of staggered trigger pulses which are applied, in a controlled sequence, to driving means 506 which are responsive to the trigger pulses to fire the infrared light emitting diode array 510 in a controlled sequence to produce the pulse, space parallel beams of radiation. The other output of divide-by-ten logic 502, represented by output 512, are utilized to trigger a flip-flop 514 which, in turn, actuates the field effect transistor buffer drive transistor 516 which applies a voltage from a voltage source 518 to the infrared light emitting diode array 510.

Figure 13:
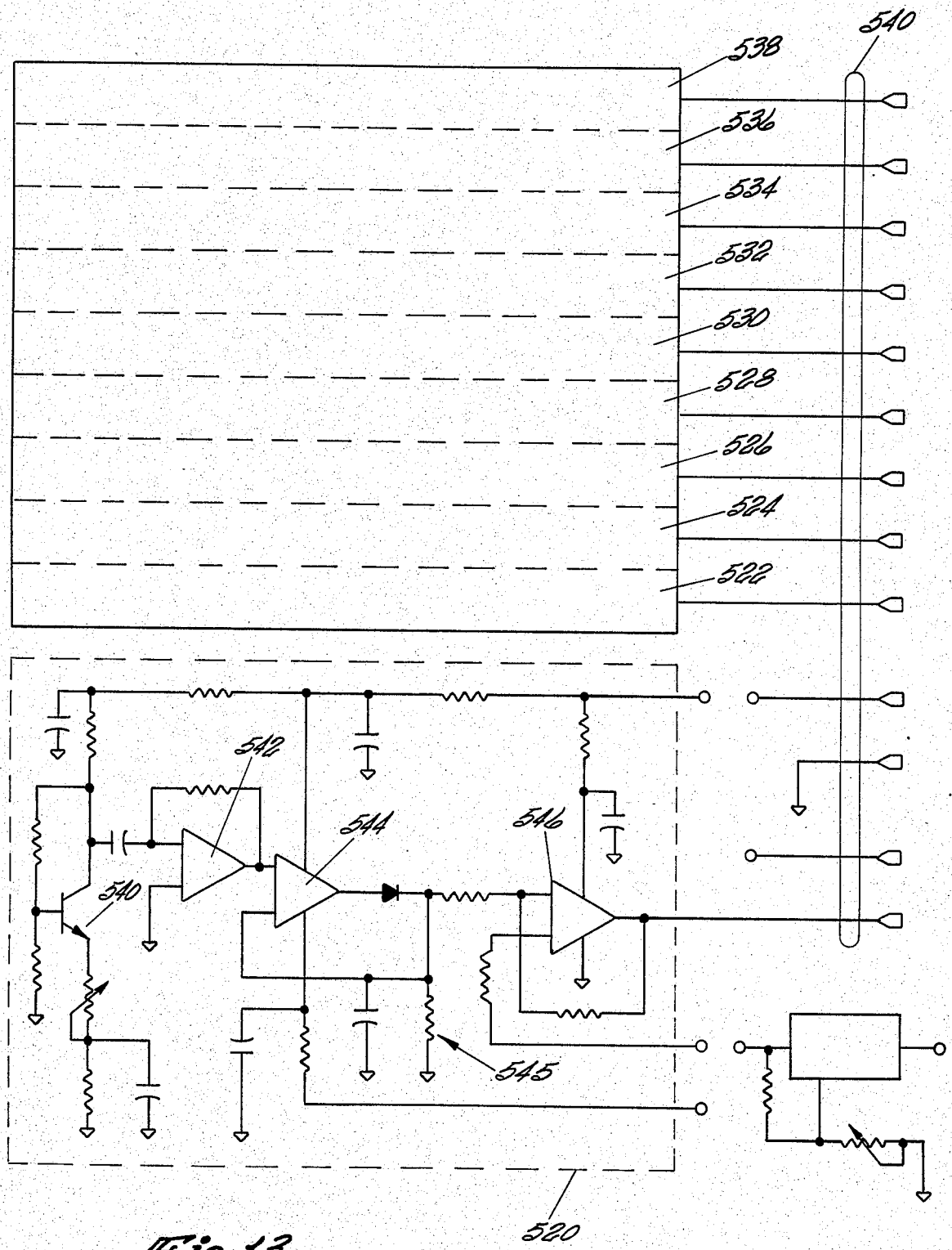
FIG. 13 is a representation, a part of which is in a schematic diagram, of the radiation receiving means in combination with the threshold detector circuit shown for a single channel, the output of which is applied to a discrimination logic.

FIG. 13 illustrates a means which is responsive to reflected radiation pulse circuit and which is enclosed by dashed box 520. Each counting apparatus would have a number of means responsive to radiation pulses which are equal in number to the source of radiation beams. Since there were ten infrared light emitting diodes in array 510 of FIG. 12, there would be ten radiation pulse receiving means which are illustrated by dashed boxes 520 to 538 in FIG. 13. Each radiation pulse receiving means would include a phototransistor 540, a current mode amplifier 542, a peak detector 544 and a threshold detector 546. The output of each threshold detector 546 is in the form of a digital output signal which would appear the output leads, which output leads are generally grouped together as output leads 540.

The output leads 540 of each of the threshold detectors 546 of each of the radiation pulse receiving means 520 are applied as an input to a discriminating logic circuitry illustrated in FIG. 14(*a*) and 14(*b*). FIGS. 14(*a*) and 14(*b*) are illustrated, accomodate two, ten infrared light emitting diode array which are arranged in and end-to-end relationship to produce a pulse, parallel beam scan pattern having twenty pulse radiation beams produced therefrom. Thus, there would be twenty radiation pulse receiving means in the configuration of that illustrated in dashed box 520 of FIG. 13. In FIG. 14(*a*), it is assumed that the input to the first ten stages are leads 540 representing the outputs of the threshold detector circuits in FIG. 13. In FIG. 14(*a*), the first ten stages of the discrimination logic are formed of a first set of NAND gates of which NAND gate 560, 562, 566 and 568 are typical. The output of each NAND gate is cross-coupled by a lead to its adjacent NAND gate to form an input lock-out arrangement. Lead 564 which is interconnected between the output of NAND gate 560 and the input of adjacent NAND gate 562 is typical. Thus, the first NAND gate of the first set of NAND gates to apply the signal to a capacitor, such as capacitor 569, produces a count signal. The capacitor differentiates the pulse and produces a count signal which appears as an output signal from that NAND gate, for example NAND gate 564. The count signal produced by capacitor 569 is applied to a NAND gate 570 of a second set of NAND gates of which NAND gates 570 and 574 are typical. The NAND gates 570, 571 and 572 lock out functions as described below, to inhibit passage of count signals. If NAND gate 570 is not locked out, the count signal is then passed by NAND gate 570 to the NAND gate 572 and the signal is then applied to the remaining portion of the descrimination logic illustrated in FIG. 15.

As discussed above, the output of NAND gate 560 is cross-coupled to the input of NAND gate 562. Likewise the output of NAND gate 562 is cross-coupled to the input of adjacent NAND gate 560 and NAND gate 566. The output of NAND gate 568 is applied as an input to NAND gate 562 together with the output of NAND gate 560. The output of adjacent NAND gates are used as inputs to the adjacent NAND gates for all of the first set of NAND gates. Thus, the first NAND gate of the NAND gates 560 and 562 to be conditioned will inhibit the immediately adjacent NAND gate. In addition the input to both NAND gates 560 and 562 are applied directly to adjacent NAND gates of the second set of NAND gates. As illustrated in FIG. 14(*a*), the signal applied to the input of 560 is applied to the input of adjacent NAND gate 571 of the second set of NAND gates. The input signal applied to NAND gate 562 is applied as an input signal to adjacent NAND gate 560 and 572 but not to NAND gate 571.

This arrangement permits the first received radiation pulse signal to be passed by the first set of NAND gates such as NAND gate 560. However, if a later received radiation pulse signal is of a greater amplitude or a longer duration, that signal will be applied to the second set of NAND gates, such as NAND gates 570, 571 and 572. In that event, the first received radiation pulse will be passed by the first set of NAND gates and applied to its associated series capacitor to produce a count signal. However, the later received pulse would lock out the second set of NAND gates to inhibit passage of the so produced count signal and later produced count signals from the NAND gates. Only the subsequently produced count signal will then be passed since the first produced count signal was inhibited.

Typically, the first received pulse signal has the largest amplitude and/or duration. In such event, when it is applied to a NAND gate of the first set, the adjacent NAND gates are inhibited and the second set of adjacent NAND gates are locked-out to inhibit passage of any subsequently produced count signals.

The inherent relationship between the infrared light emitting diodes in the diode array and the position of the radiation pulse receiving means such as the phototransistor are important. For example, if the smallest size of an object to be counted is 2 inches in diameter, it is necessary for that object to be able to trigger or apply radiation pulses to two sensors at the same time. For a 2 inch object, in the preferred embodiment, the sensors need to be spaced 1 inch apart. In the embodiment illustrated in FIG. 1, the objects placed on a conveyor line are in a random pattern and they may or may not be positioned against the edge of the conveyor line. Thus, the first sensor and radiation pulse source needs to be positioned 1 inch in from the edge of the conveyor line in order to sense a 2 inch object Thus, on a 12 inch conveyor line, there need only be ten radiation pulse producing means and ten radiation pulse receiving means in order to make the system operative. Also, it is possible that two or more objects could pass through and be scanned by the pulse radiation beam and it is necessary for the discrimination logic to logically determine that the synchronization relationship exists and to produce an appropriate output pulse therefrom.

The staggering of the triggering pulses to trigger the infrared light emitting diode array to produce the pulsed parallel beams of radiation in a scan pattern enables the discrimination logic to receive output signals which is responsive to the first received radiation pulses. Inherent timed sequence relationship exists between adjacent pulses such that the discrimination logic will be responsive to the first received radiation pulse output signal to pass a count signal and to inhibit data received radiation output pulse signals from adjacent pulse receiving means to ensure that only one pulse count occurs for each article thereby permitting the counting apparatus to count two or more articles passing concurrently through the article counting stage.

FIG. 14(*b*) illustrates the discrimination logic for the second ten element infrared light emitting diode array which can be actuated in either a staggered or synchronized relationship with the first ten stages of radiation pulse receiving means illustrated in FIG. 14(*a*).

Figure 15:
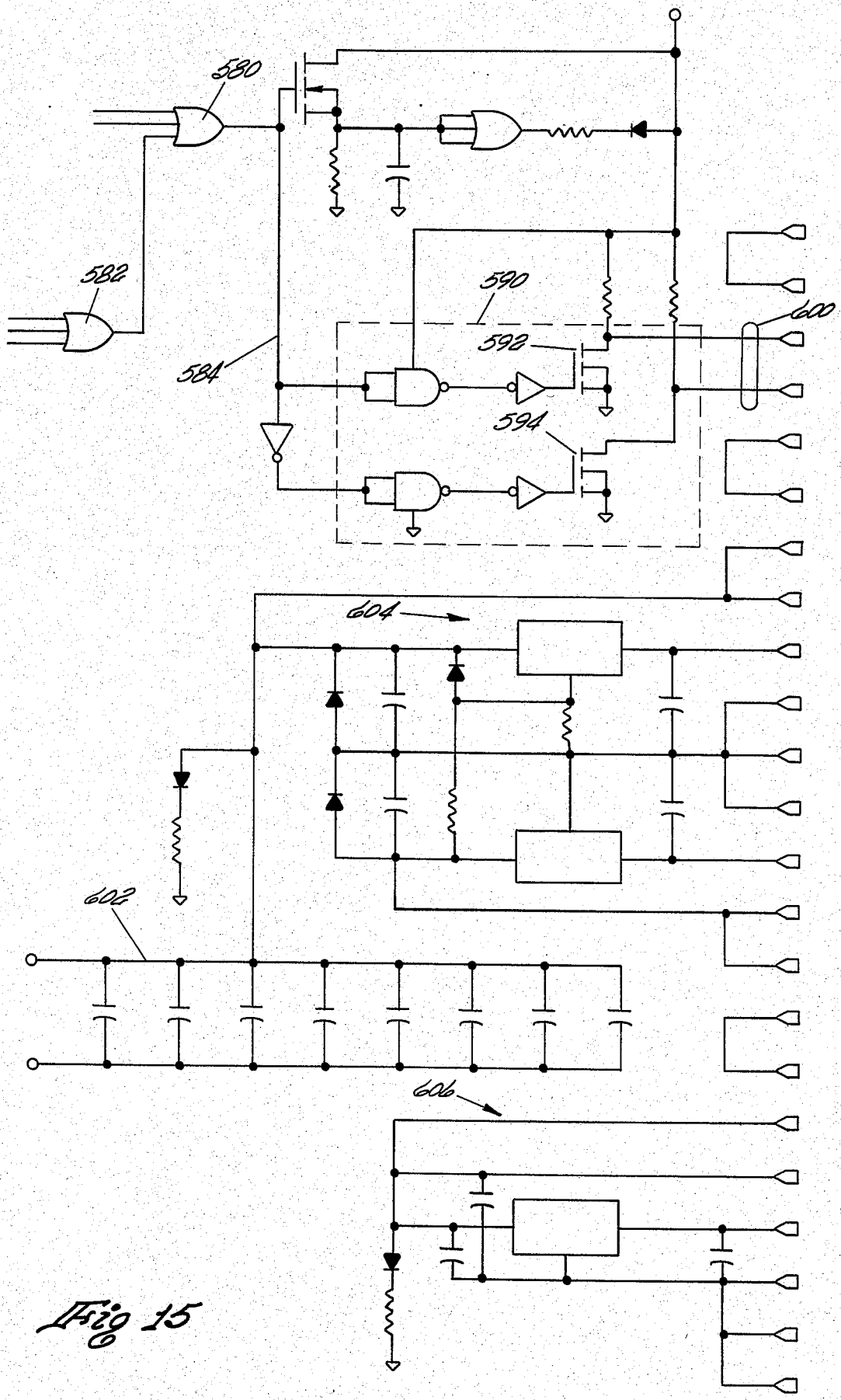
FIGS. 15 is a schematic diagram, a portion of which is a logic diagram, illustrating the control circuitry for the discrimination logic.

FIG. 15 illustrates combination orgates 580 and 582 which are responsive to the inputs received from the accumulating NAND gates 572 and 574 of FIG. 14(*a*). The output of the orgates 580 and 582 are accumulated and appear on output 584 which is applied as a input to a line driving circuit 590. The output of the two wire line driving circuit has a pair of field effect transistor drivers 592 and 594 to apply the signals across a two conductor output conductor which is illustrated by output lines 600.

The capacitive matrix shown generally as 602 is utilized as a decoupling circuit for the receiver circuit, the circuit illustrated by arrow 604 is a power supply for the discrimination logic and the receiver circuits. The circuit 606 is a transmitter power supply circuit to actuate the transmitter means.

Figure 16:
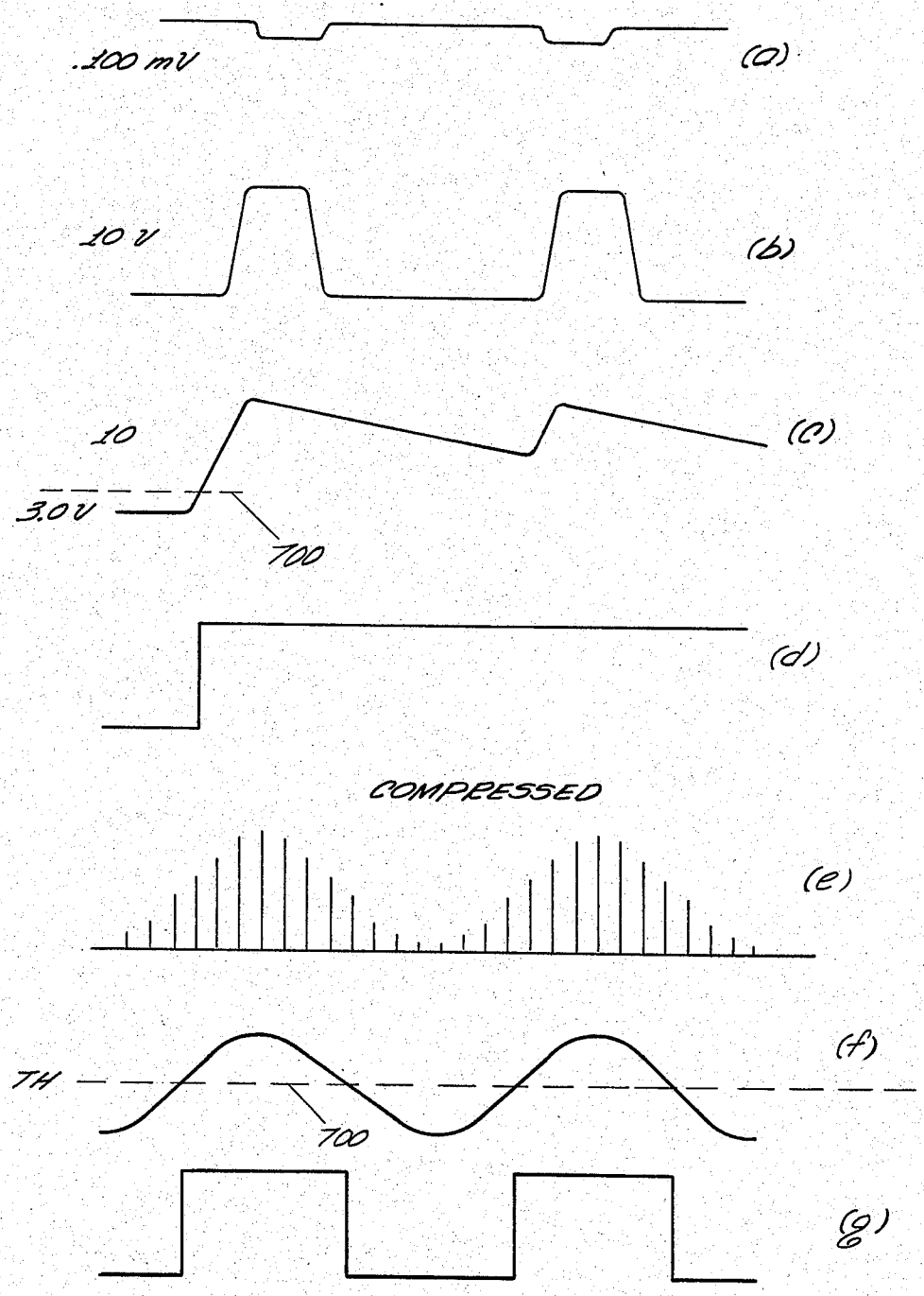
FIGS. 16(*a*) through 16(*f*), inclusive, are waveforms representing various points of the discrimination logic of FIGS. 14(*a*) and 14(*b*)

FIG. 16 are typical wave forms which appear at various stages of the radiation pulse receiving means circuitry which is illustrated in FIG. 13. The wave form illustrated as FIG. 16(*a*) is the output of the phototransistor 540 and would have a voltage in the order of 0.100 milliwatts.

The output of the current mode amplifier 540 is illustrated as wave form 16(*b*) and would be amplified to a level of for example 10 volts.

The output of the current mode amplifier 542 is applied as an input to the peak detector 544 which applies as output across an RC timing circuit 545 to produce a ramp-type input to the threshold detector circuit 546. The wave form illustrated in FIG. 16C is a ramp voltage having a 10 volt peak. The reference voltage is illustrated by dash line 700 of FIG. 16(*c*) and is for purposes of example, at the 3.0 volt level. The output of the threshold detector 546 is illustrated as wave form 16(*d*) and is a step voltage format which is utilized as an input to the NAND gate stages of the discrimination logic illustrated such as for example on FIG. 14(*a*).

FIGS. 16(*e*), 16(*f*) and 16(*g*) are compressed wave forms of the pulses indicated in FIG. 16(*b*), 16(*c*) and 16(*d*), respectively. As noted by the envelope of the compressed wave forms in FIG. 16(*e*), the wave form is generally sinusoidal in shape. FIG. 16(*f*) shows that the envelope of the input signals applied to the threshold detector vary relative to the threshold voltage illustrated by dash line 700. The output of the threshold detector is a pulse modulated output wave having the durations of the pulses determined by the timing in which the radiation output pulses are received by the phototransistor of each radiation pulse receiving means.

Figure 17:
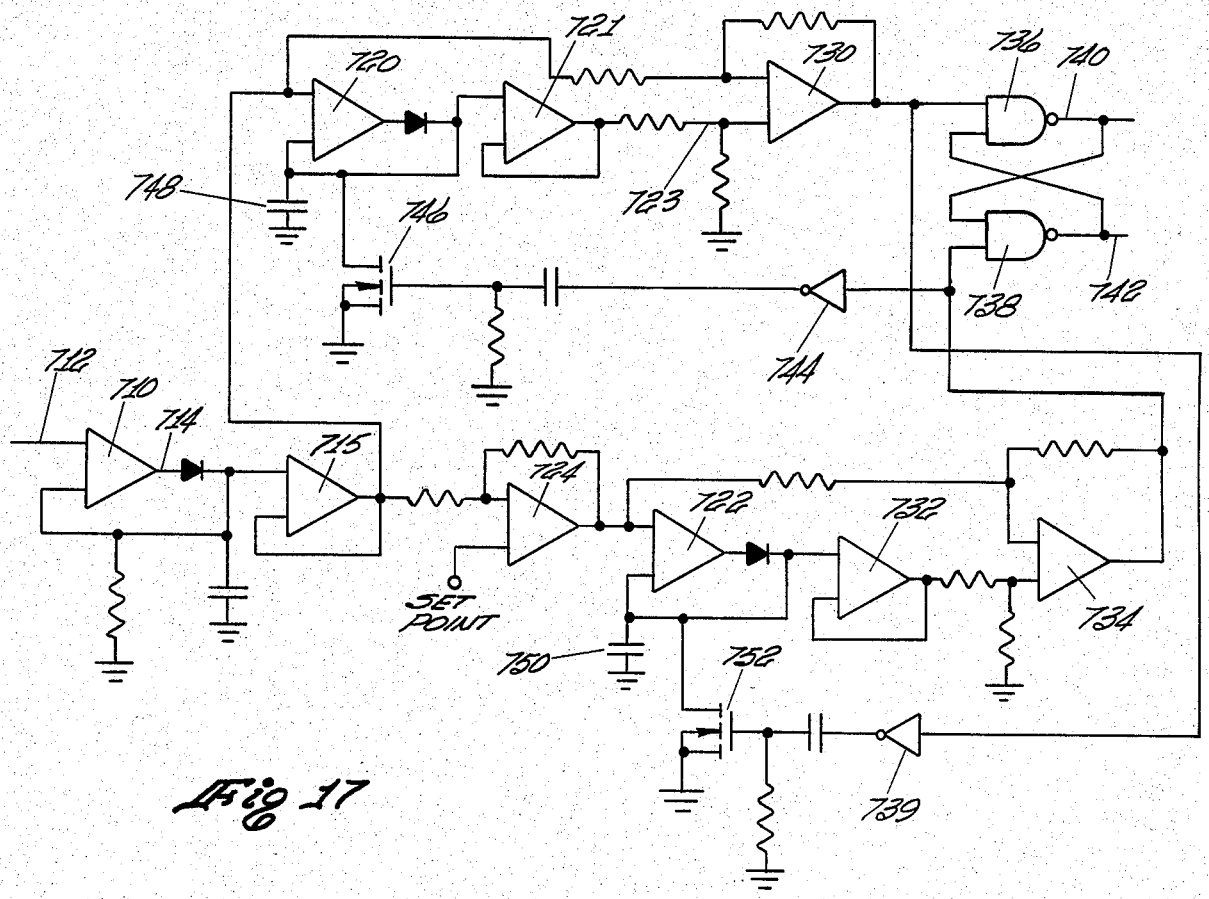
FIG. 17 is an embodiment of an automatic threshold circuit for varying the reference level to accomodate a wider range of differences in geometrical dimensions of the articles to be counted.

FIG. 17 illustrates an alternate embodiment for the threshold detector circuit illustrated as 546 in the dashed box 520 of FIG. 3. The automated threshold detector circuit receives the output from a peak detector 710. Peak detector 710 has an input 712 which is the output signal of a current mode amplifier such as the current mode amplifier 542 of FIG. 13. The output from the peak detector 710 appears on output 714 and is applied through a buffer circuit 715 to a positive going signal sample and hold circuit 720 and, via an inverting amplifier 724, to a negative going signal sample and hold circuit 722. The waveform of the signal from the peak detector 710 is illustrated as waveform 802 in FIG. 18. In operation, the positive going signal an output 714 and buffer amplifier 715 is applied to the sample and hold circuit 720 and is concurrently applied as one input to a comparator 730, having two inputs. The second input to the comparator 730 is the output signal from the sample and hold circuit which passes through a buffer circuit 721 and voltage dividing network 723. When the signal applied directly to the first input of the sample and hold circuit 720 is increasing positively in voltage, that signal is directly applied to the first input of comparator 730 causing the output thereof to be a high output voltage, for example, 10 volts. The second input to comparator 730 is at a low level to insure the comparator 730 output is at a high level.

This high output level voltage signal is applied to a NAND gate flip-flop having NAND gates 736 and 738. Specifically, the high output voltage is applied to one input of NAND gate 736 causing the output to switch from a low (0) to a high (1) output. The output of NAND gate 736 is cross-coupled and applied as an input to NAND gate 738 causing the output thereof to switch from a high (1) to a low (0). In addition, the output of the oomparator 730 is applied via an inverter 739 to a FET 752 which discharges a capacitor 750 preparing the sample and hold circuit 722 for response to a negative going signal.

Figure 18:
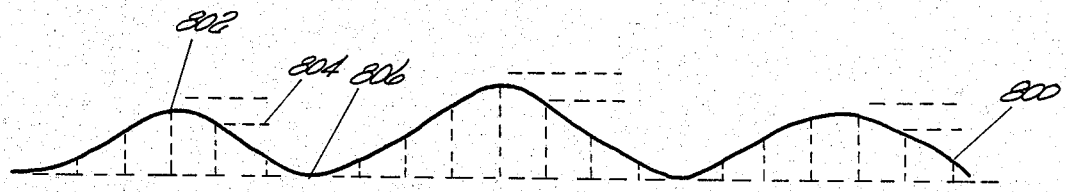
FIG. 18 is a waveform illustrating the variances in amplitude of the various signals to which the automatic threshold detective circuit is responsive.

When the positive going portion of the signal on output 714 of peak detector 710 reaches a peak, which peak is illustrated peak 802 in FIG. 18, the signal then becomes negative going, that is, begins to reduce in voltage. The signal is applied via a buffer 715 and to the inverting amplifier 724 to a sample and hold circuit 722 having the discharged capacitor 750. When the negative going voltage has changed magnitude in the order of 10%, as shown by point 804 a waveform 802 in FIG. 18, the inverting amplifier 724 sets its output at a high voltage, such as 10 volts, and that output is applied to the sample and hold circuit 722 and charging capacitor 750. Concurrently, the high output is applied to the inverting gate 744 and to one input of the NAND gate 738. The output of second comparator 734 switches from a high signal (1) to a low signal (0) which is applied to the inverter 744 which produces a high signal (1) which is then applied to the FET 746. Also, the output of comparator 734 is applied to the NAND gate flip-flop and specifically to the input of NAND gate 738. NAND gate 738, having a high signal (1) from the output of NAND gate 736 and a high signal (1) from the inverter 744 switches to produce a low signal (0) in its output which is cross-coupled to the input of NAND gate 736 causing the NAND gate 736 output to switch from a high signal (1) to a low signal (0) resulting in the output of the NAND gate 738 remaining at a low signal (0).

The output or high signal (1) from the inverter amplifier 744 which is applied to a FET 746 which discharges capacitor 748 for the next positive going portion of the pulse.

The capacitors 742 and 746, when changed, function to keep the second input to the comparators 730 and 734, respectively, at a low voltage until the 10% level of the peak or voltage of the waveform occurs whereupon the comparator output switches from a high signal to a low signal.

Figure 19:
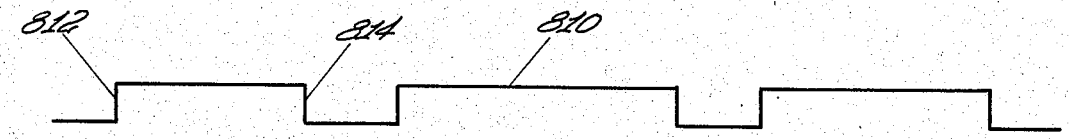
FIG. 19 is a waveform illustrating the output signal from the NAND gate flip-flop which is used as the input to the discrimination logic.

The switching of the outputs of the NAND gates 736 and 738 produce a digital output signal illustrated in FIG. 19 which in turn is applied to the discrimination logic illustrated in FIGS. 14(*a*) and 14(*b*).

The circuitry in FIG. 17 has application as a counting apparatus where the objects to be first counted are of a first size which are followed by a random sequence of objects of a second size. The automatic threshold logic would adjust between the peak and the valley of the signals illustrated in FIG. 18 such that the automatic threshold level would vary in response to geometrical dimension of the objects to be counted such that the apparatus with an automatic threshold detector would sense and count objects so long as there is a signal received by the radiation pulse receiving means.

The preferred application of the present invention is a method for counting citrus of substantially the same size, such as for example lemons. However, as is apparent from the description set forth herein, the geometrical dimension of objects to be counted by the counting apparatus can vary provided that the variance thereof is within the threshold range of the counting apparatus.

As illustrated with respect to FIG. 1, the preferred embodiment is to utilize the pulsed, space parallel radiation beam and a scan pattern which intercepts the article counting stage at an angle such that objects passing through the article counting stage will intercept the pulse radiation beam and produce a reflected radiation pulse therefrom which travels along different reflective paths to a radiation pulse receiving means However, it is readily apparent that the objects can directly intercept the pulse radiation beams such that the presence or absence of a radiation pulse by direct transmission to a receiver can likewise be utilized to produce counts. Such a device would have application in a pill counting apparatus wherein a plurality of pills having known geometrical sizes are passed in a thin web through an outlet and past an article counting stage wherein the pulse spaced radiation beams pass directly through to radiation pulse receiving means. In this application, the objects intercept the pulse space parallel beams and the reflection thereof is not received by the pulse receiving means but the presence or absence of the pulse is utilized to perform the counting function.

It is also envisioned that by use of automatic threshold circuitry of the present invention that groups of objects arranged in a random pattern but which have geometrical dimensions which exceed the threshold range can be grouped and counted by use of an automatic threshold circuit.

It is further envisioned that the counting apparatus could be combined with additional logic to count and sort articles transported along a predetermined path in a selected direction which are in a random pattern and which have a wide range of geometrical dimensions. This can be accomplished by arranging counting stages along the same predetermined path wherein each specific apparatus for counting is directed toward counting objects which have a geometrical dimension which fall falls within its threshold range.

It is further envisioned that the output signals can be utilized with further control means to accomplish downstream segregation of objects by size, by color or by quality.

What is claimed is:

1. Apparatus for counting articles traveling in a random pattern along a predetermined path in a selected direction comprising means positioned along said predetermined path for defining an article counting stage which is adapted to have passed therethrough articles to be counted which are traveling in a random pattern along said predetermined path in a selected direction;

means positioned relative to said article counting stage for producing in a scan pattern thereacross a plurality of pulsed, spaced parallel beams of radiation such that each article is adapted to have at least two selected portions thereof independently intercept at least two beams of radiation and to reflect therefrom at least two pulses of radiation along different reflection paths, each of said radiation beams being directed along a scan path into said article counting stage and each of which is adapted to be intercepted by a selected portion of said article passing through said article counting stage and to reflect therefrom a pulse of radiation along a reflection path;

means positioned relative to said article counting stage and positioned relative to said radiation beam producing means for receiving said at least two pulses of radiation from at least two separate radiation beams being intercepted by and reflected from different selected portions of a said article and for producing therefrom output signals in a time spatial sequence representing that the radiation level of at least two received pulses of radiation exceeded a threshold level and with the time spatial sequence therebetween commencing with the first received radiation pulse output signal; and logic means operatively coupled to said radiation receiving means for receiving said output signals and responding to the first received radiation pulse output signal to produce and pass a count signal and, to inhibit passing of count signals produced from later received radiation pulse output signals from the same article unless a later received radiation output pulse is of at least one of a greater amplitude and duration whereupon the count signal produced therefrom is passed and the count signals from the first received radiation pulse output signal and other count pulses are inhibited.

2. The apparatus for counting articles of claim 1 further comprising counting means operatively coupled to said logic means and responsive to said count signal for summing the number of count signals received from said logic means representing a count of the number of articles passed through the article counting stage.

3. The apparatus for counting articles of claim 1 wherein said radiation beam producing means comprises an infrared light emitting diode array arranged in an aligned linear scan pattern;

driving means operatively coupled to said infrared light emitting diode array for pulsing each of said light emitting diodes in a controlled pattern to produce a scan pattern of infrared radiation beams having discrete spacings therebetween; and circuit means including means for producing triggering pulses operatively coupled to said driving means for pulsing each of said light emitting diodes in response to the triggering pulses to produce a scan pattern of infrared radiation in a controlled pattern determined and at a frequency determined by the triggering pulses.

4. The apparatus of claim 3 wherein said infrared light emitting diode array comprises a first infrared emitting diode array and a second infrared emitting diode array.

5. The apparatus of counting articles of claim 4 wherein said first infrared emitting diode array and said second infrared emitting diode array are positioned in an end-to-end relationship to produce a linear scan pattern comprising beams of radiation wherein a beam of radiation is derived from each of the infrared emitting diodes.

6. The apparatus for counting articles of claim 3 wherein said circuit means further comprises an oscillator for producing electrical signals at a predetermined frequency; and pulse dividing means operatively coupled to said oscillator for reducing the number of pulses in a predetermined ratio to produce triggering pulses.

7. The apparatus for counting articles of claim 6 wherein said driving means are formed of field effect transistor buffer drivers which are responsive to the triggering pulses to fire each infrared emitting diode in a controlled sequence.

8. The apparatus for counting of articles of claim 1 wherein said radiation beam receiving means comprises a plurality of aligned, spaced discrete radiation responsive receiving means which are adapted to produce an electrical signal having a pulse width and an amplitude determined by the characteristics of each radiation pulse received thereby;

amplifying means operatively coupled to each of said discrete infrared receiving means for producing a pulsed output signal having an amplitude determined by the amplitude of the electrical signal generated by said radiation receiving response means; and a peak detector operatively coupled to said amplifying means for receiving said pulsed output signal and for producing in response thereto an analog output signal; and threshold detecting means operatively coupled to said peak detector means and responsive thereto for comparing the output analog signal to a reference signal and for producing an output signal if the amplitude of the output analog signal exceeds said reference signal.

9. The apparatus of claim 8 wherein said logic means further includes a plurality of NAND gates which are operatively coupled to the threshold detector associated with a selected one of said radiation receiving means and to the threshold detector associated with a different selected one of said radiation receiving means, said NAND gates being responsive to the output signal generated by the associated threshold detection and to an output signal generated by the threshold detector of the different selected one of said radiation receiving means to produce a count signal therefrom if the output signal received from its associated threshold detector circuit is the first received radiation pulse output signal and to apply said first received radiation pulse output signal as an inhibiting signal to the input of an adjacent NAND gate of the threshold detector or associated with a different selected one of said radiation receiving means to inhibit the NAND gate from responding to a later received radiation pulse output signal which is in a spatial sequence to said first received radiation pulse signal wherein said NAND gate responding to said first received radiation pulse output signal produces the count signal which is representative of an article to be counted.

10. A method for counting articles traveling in a random pattern along a predetermined path in a selected direction comprising defining an article counting stage which is positioned along said predetermined path and which is adapted to have passed therethrough articles to be counted which are traveling in a random pattern along said predetermined path and in a selected direction;

producing in a scan pattern across the article counting stage a plurality of pulsed, spaced parallel beams of radiation, each of which is directed along a scan path into the article counting stage and each of which is adapted to be intercepted by a selected portion of a said article passing through the article counting stage; and to reflect therefrom a pulse of radiation along a reflection path;

passing a plurality of said articles through said article counting stage in a random pattern so as to intercept said plurality of pulsed, spaced parallel beams of radiation being scanned across the article counting stage in a scan pattern wherein each article is adapted to have at least two selected portions thereof independently intercepted by at least two beams of radiation and for reflecting therefrom at least two pulses of radiation along different reflective paths;

receiving with a plurality of radiation receiving means positioned in a predetermined array relative to the article counting stage said pulses of radiation intercepted by and reflected from different selected portions of a said article and for producing therefrom output signals representing the radiation level of at least two received pulses of radiation exceeding a threshold level with a time spatial sequence therebetween commencing with the first received radiation pulse output signal; and discriminating with a logic means to pass the first received radiation pulse output signal in the time spatial sequence as a count signal and to inhibit passing of later received radiation pulse output signals as a count signal unless a later received radiation pulse is at least of a greater amplitude and duration whereupon that pulse is passed as a count signal and the count pulses produced from the first received radiation pulse output signal and the other later received radiation pulse output signals are inhibited.

11. The method of claim 10 further comprising the step of accumulating each of the passed count signals to produce a total count representing an integration of all of the passed count signals received thereby independent of the time spatial relationship therebetween.

12. Apparatus for counting articles traveling along a predetermined path in a selected direction comprising means positioned along said predetermined path for defining an article counting stage which is adapted to have passed therethrough articles to be counted;

means positioned relative to said article counting stage for producing in a scan pattern thereacross a plurality of pulsed, spaced parallel beams of radiation, each of which is directed along a scan path into said article counting stage and each of which is adapted to be intercepted by a selected portion of said article passing through said article counting stage; said radiation beam producing means being adapted to produce said plurality of pulsed, spaced parallel beams of radiation in a scan pattern such that each article is adapted to have at least two selected portions thereof independently intercept at least two beams of radiation;

means positioned relative to said article counting stage and positioned relative to said radiation beam producing means for responding to the different selected portions of a said article intercepting the two separate radiation beams for producing therefrom output signals in a time spatial sequence representing that the radiation level of at least two received pulses of radiation exceeded a threshold level and with the time spatial sequence therebetween commencing with the first received radiation pulse pass a count signal produced from the first received radiation pulse output signal unless a later received radiation pulse output signals is at least of a greater amplitude and duration which results in the inhibiting of passing such count signal and the passing of a subsequent count signal produced from a later received radiation output pulse signal from the same article.

13. The apparatus for counting articles of claim 12 wherein said radiation beam producing means comprises an infrared light emitting diode array arranged in an aligned linear scan pattern;

driving means operatively coupled to said infrared light emitting diode array for pulsing each of said light emitting diodes in a controlled pattern to produce a scan pattern of infrared radiation beams having discrete spacings therebetween; and circuit means including means for producing triggering pulses operatively coupled to said driving means for pulsing each of said light emitting diodes in response to the triggering pulses to produce a scan pattern of infrared radiation in a controlled pattern determined and at a frequency determined by the triggering pulses.

14. The apparatus of claim 12 wherein said plurality of pulsed spaced parallel beams intercept said articles at an angle to produce reflected radiation pulses and wherein responding means includes radiation pulse receiving means which are responsive to the reflected radiation pulses to produce the output signals.

15. The apparatus of claim 12 wherein said plurality of pulsed, spaced parallel beams are intercepted by selected portion of said article to produce a pulse representing the absence of a radiation pulse between the time each pulsed radiation beam is terminated and the time when a said article again intercepts a pulsed, parallel beam and wherein said responding means includes radiation pulse receiving means which are responsive to the absence of radiation pulses to produce output signals.

16. Means for counting articles being transported along a predetermined path comprising means positioned along said predetermined path for defining an article counting stage which is adapted to have passed therethrough articles to be counted;

means positioned relative to said article counting stage for producing thereacross a plurality of pulsed, spaced parallel beams of radiation such that each article is adapted to have at least two selected portions thereof independently intercept at least two beams of radiation and to reflect radiation therefrom along different reflection paths;

means positioned relative to said article counting stage and positioned relative to said radiation beam producing means for receiving said reflected radiation and for producing therefrom output signals in a time spatial sequence representing that the radiation level of the reflected radiation exceeded a threshold level and with the time spatial sequence therebetween commencing with the first received radiation output signal; and logic means operatively coupled to said radiation receiving means for receiving said output signals and responding to the first received radiation output signal to produce and pass a count signal and to inhibit passing of count signals produced from later received radiation output signals from the same article unless a later received radiation output signal is of at least one of a greater amplitude and duration whereupon the count signal produced therefrom is passed and the count signal from the first received radiation output signal and other count signals are inhibited.

17. The article counting means of claim 16 wherein said radiation output signal means further includes a plurality of radiation responsive means which is adapted to produce an output signal having a pulse width and an amplitude determined by the characteristics of each radiation received thereby;

amplifying means operatively coupled to said radiation responsive means for producing a pulsed output signal having an amplitude determined by the amplitude of the output signal received from the radiation responsive means;

peak detecting means operatively coupled to said amplifying means for receiving said pulsed output signal and for producing in response thereto an analog output signal; and threshold detecting means operatively coupled to said peak detecting means and responsive thereto for comparing the output analog signal to a reference signal and for producing an output signal if the amplitude of the output analog signal exceeds said reference signal.

18. The article counting means of claim 17 wherein said threshold detecting means includes means for detecting at least one of a change in the amplitude and phase of said analog signal for producing a variable reference signal therefrom.

19. A threshold detector responsive to the envelope of a plurality of variable amplitude pulses for producing a digital output signal comprising a first sample and hold means adapted to be responsive to a said envelope increasing in amplitude for producing a first control signal;

a second sample and hold means adapted to be responsive to a said envelope decreasing in amplitude for producing a second control signal;

a first comparator which is responsive to said first control signal and to a said envelope for producing a first output signal at a selected amplitude in response to a said envelope increasing in amplitude;

a second comparator which is responsive to said second control signal and to a said envelope for producing a second output signal at a different selected amplitude in response to a said envelope decreasing in amplitude; and a NAND gate flip-flop adapted to receive said first output signal and said second output signal for producing a digital output signal having a first state and a second state wherein the digital output signal is at its first state when said first output signal selected amplitude is greater than the different selected amplitude of said second output signal and at its second state when said second output signal different selected amplitude is greater than the selected amplitude of said first output signal.

20. The threshold detector of claim 19 further comprising a first voltage dividing means operatively coupled between said first sample and hold means and said first comparator for producing and applying an input signal thereto which is substantially lower in amplitude than the positive going amplitude of a said envelope; and a second voltage dividing means operatively coupled between said second sample and hold mans and said second comparator for producing and applying an input signal thereto which is substantially lower in amplitude than the negative going amplitude of a said envelope.

21. The threshold detector of claim 20 wherein each of said first and second sample and hold means include a changing capacitor; and a field effect transistor switch which is responsive to the output of the comparator operatively coupled to the other sample and hold means for discharging its associated charging capacitor in response to the comparator having a control signal on the output thereof.

* * * * *